US010930487B2

(12) United States Patent
Badiei et al.

(10) Patent No.: US 10,930,487 B2
(45) Date of Patent: Feb. 23, 2021

(54) DOUBLE BEND ION GUIDES AND DEVICES USING THEM

(71) Applicant: PERKINELMER HEALTH SCIENCES CANADA, INC., Woodbridge (CA)

(72) Inventors: Hamid Badiei, Woodbridge (CA); Samad Bazargan, York (CA)

(73) Assignee: PerkinElmer Health Sciences Canada, Inc., Woodbridge (CA)

( * ) Notice: Subject to any disclaimer, the term of this patent is extended or adjusted under 35 U.S.C. 154(b) by 0 days.

(21) Appl. No.: 16/536,855

(22) Filed: Aug. 9, 2019

(65) Prior Publication Data

US 2020/0144045 A1 May 7, 2020

Related U.S. Application Data

(63) Continuation of application No. 15/163,957, filed on May 25, 2016, now Pat. No. 10,381,210.

(60) Provisional application No. 62/166,594, filed on May 26, 2015.

(51) Int. Cl.
*H01J 49/06* (2006.01)

(52) U.S. Cl.
CPC ..... *H01J 49/063* (2013.01); *H01J 49/061* (2013.01); *H01J 49/067* (2013.01)

(58) Field of Classification Search
CPC ..... H01J 49/063; H01J 49/06; H01J 49/061; H01J 49/067
See application file for complete search history.

(56) References Cited

U.S. PATENT DOCUMENTS 6,891,157 B2 * 5/2005 Bateman ..... H01J 49/065 250/292
10,381,210 B2 * 8/2019 Badiei ..... H01J 49/063

* cited by examiner

*Primary Examiner* — Nicole M Ippolito
*Assistant Examiner* — Hanway Chang
(74) *Attorney, Agent, or Firm* — Rhodes IP PLC; Christopher R Rhodes

(57) ABSTRACT

Certain configurations of devices are described herein that include a DC multipole that is effective to doubly bend the ions in an entering particle beam. In some instances, the devices include a first multipole configured to provide a DC electric field effective to direct first ions of an entering particle beam along a first internal trajectory at an angle different from the entry trajectory of the particle beam. The first multipole may also be configured to direct the ions in the first multipole along a second internal trajectory that is different than the angle of the first internal trajectory of the particle beam.

20 Claims, 14 Drawing Sheets

DOUBLE BEND ION GUIDES AND DEVICES USING THEM

PRIORITY APPLICATION

This application is a continuation of U.S. application Ser. No. 15/163,957 filed on May 25, 2016, which issued as U.S. Pat. No. 10,381,210 on Aug. 13, 2019. U.S. application Ser. No. 15/153,957 claims priority to, and the benefit of, U.S. Provisional Application No. 62/166,594 filed on May 26, 2015, the entire disclosure of which is hereby incorporated herein by reference for all purposes.

TECHNOLOGICAL FIELD

Aspects and features of the present technology relate generally to methods and devices for directing ions, and more particularly for doubly bending ions within an entry particle stream along a desired internal path.

BACKGROUND

Ions may be directed along a path by exposing the ions to electric and/or magnetic fields. The utilization of such fields to guide ions has numerous practical applications. A common use of multipole ion flow guides within analytical chemistry is as mass analyzers within mass spectrometers. A mass spectrometer is a device that identifies ions according to their mass-to-charge ratio. As the particle stream containing the ions to be analyzed passes through the mass analyzer, the ions are transmitted based on their mass-to-charge ratio towards a detector, which detects the ions based on their charge or momentum.

Ideally, only the ions to be analyzed reach the detector. It is often the case, however, that particles not of interest such as neutrals and photons reach the detector resulting in false signals. Additionally, the presence of neutral species in addition to the ions to be analyzed within a particle stream introduced into a mass analyzer may lead to fouling of the mass analyzer and/or other complications affecting the accuracy of the mass spectrometer.

For example, the particle stream introduced to the mass analyzer often undesirably contains photons. The presence of photons within the particle stream may lead to elevated background levels and/or increase the noise within the detector. In addition, the openings of some ion guides may be narrow and prone to contamination by the entering neutral species thereby causing instrument drift.

SUMMARY

Various aspects are described herein that are directed to (or use) a multipole device configured to doubly bend an ion beam within the multipole device.

In one aspect, a device comprising a first multipole comprising a plurality of electrodes configured to provide a DC electric field effective to direct first ions of an entering particle beam along a first internal trajectory that is substantially orthogonal to an entry trajectory of the particle beam, in which the plurality of electrodes of the first multipole are further configured to direct the directed, first ions along a second internal trajectory that is substantially orthogonal to the first internal trajectory is provided.

In certain configurations, a first set of poles of the first multipole are configured to direct the first ions along the first internal trajectory, and a second set of poles of the first multipole are configured to direct the first ions along the second internal trajectory. In some instances, each of the first set and the second set comprises a pair of poles. In other instances, the first set of poles and the second set of poles are each configured to provide the DC electric field using a direct current voltage applied to each electrode of the first multipole. In other embodiments, the direct current voltage applied to each electrode of the first multipole is a different direct current voltage. In certain instances, the electrodes are configured to direct the first ions along the second internal trajectory in a direction that is substantially parallel to a direction of the entry trajectory. In other instances, the electrodes are configured to direct the first ions along the second internal trajectory in a direction that is substantially antiparallel to a direction of the entry trajectory. In some embodiments, the device may further comprise at least one electrode positioned at an exit aperture of the first multipole. In other embodiments, the device may comprise at least one electrode or a lens positioned at an exit aperture of the first multipole. In some embodiments, the first multipole is configured as a DC quadrupole.

In another aspect, a device comprising a first multipole comprising a plurality of electrodes configured to provide a DC electric field effective to direct first ions of an entering particle beam along a first internal trajectory that is substantially orthogonal to an entry trajectory of the particle beam, in which the plurality of electrodes of the first multipole are further configured to direct the directed, first ions along a second internal trajectory at a first angle to the directed, first trajectory, in which the first angle of the second internal trajectory is greater than zero degrees and less than ninety degrees (relative to the first internal trajectory) is described. If desired, the angle may be greater than zero degrees and less than negative ninety degrees relative to the first internal trajectory.

In some examples, a first set of poles of the first multipole are configured to direct the first ions along the first internal trajectory, and a second set of poles of the first multipole are configured to direct the first ions along the second internal trajectory. In other examples, each of the first set and the second set comprises a pair of poles. In some examples, the cross-sectional shape of one pole of the first set of poles and the second set of poles is different. In other examples, the first set and the second set are each configured to provide the DC electric field using a direct current voltage applied to each electrode of the first multipole. In further embodiments, the direct current voltage applied to each electrode of the first multipole is a different direct current voltage. In some examples, the electrodes are configured to direct the first ions along the second internal trajectory at about a positive forty-five degree angle to the angle of the first internal trajectory. In other examples, the electrodes are configured to direct the first ions along the second internal trajectory at about a negative forty-five degree angle to the angle of the first internal trajectory. In certain instances, the electrodes are configured to direct the first ions along the second internal trajectory at an angle greater than forty-five degrees to the angle of the first internal trajectory, e.g. between 45 degrees and 90 degrees. In other instances, the electrodes are configured to direct the first ions along the second internal trajectory at an angle greater than negative forty-five degrees to the angle of the first internal trajectory, e.g., between −45 degrees and −90 degrees. In some instances, the device may comprise at least one lens positioned at an exit aperture of the first multipole. In some configurations, one or more electrodes or lenses can be placed at an entrance aperture of the first multipole. In other instances, the first multipole is configured as a DC quadrupole.

In an additional aspect, a device comprising a first multipole comprising a plurality of electrodes configured to provide a DC electric field effective to direct first ions of an entering particle beam along a first internal trajectory at a first angle different from an angle of the entering particle beam, in which the plurality of electrodes of the first multipole are further configured to direct the directed, first ions along a second internal trajectory at a second angle different than the angle of the first trajectory is disclosed.

In certain embodiments, the first angle is about positive ninety degrees from the angle of the entering particle beam. In other embodiments, the first angle is about negative ninety degrees from the angle of the entering particle beam. In some instances, the second angle is about positive ninety degrees from the first angle or about negative ninety degrees from the first angle. In certain embodiments, the second angle is about positive or negative forty-five degrees from the first angle. In some configurations, a first set of poles of the first multipole are configured to direct the first ions along the first internal trajectory, and a second set of poles of the first multipole are configured to direct the first ions along the second internal trajectory. In some embodiments, the first set and the second set are each configured to provide the DC electric field using a direct current voltage applied to each electrode of the first multipole. In certain embodiments, the cross-sectional shape of at least one pole of the first set is different than a cross-sectional shape of one of the poles of the second set. In some embodiments, the device comprises at least one electrode positioned at an exit aperture of the first multipole. In other instances, the device comprises at least electrode or at least one lens positioned at an exit aperture of the first multipole. In some instances, the first multipole is configured as a DC quadrupole.

In another aspect, a method comprising deflecting ions of a particle beam that enter a first multipole along a first trajectory, in which the first trajectory is substantially orthogonal to an entry trajectory of the particle beam, and deflecting the deflected ions of the first trajectory along a second trajectory using the first multipole, in which the second trajectory is substantially orthogonal to the first trajectory is provided.

In certain instances, the method comprises configuring the first multipole with a DC electric field to deflect the ions along the first trajectory and the second trajectory. In other examples, the method comprises configuring the first multipole to deflect ions along the second trajectory in a substantially antiparallel direction to a direction of the entry trajectory. In some embodiments, the method comprises configuring the first multipole to deflect the ions along the second trajectory in a direction that is substantially parallel to a direction of the entry trajectory. In certain examples, the method comprises focusing ions exiting the first multipole along the second trajectory using at least one lens. In further examples, the method comprises focusing ions entering the first multipole using a set of electrodes. In some embodiments, the method comprises applying a different direct current voltage to at least one pole of the first multipole. In some examples, the method comprises configuring at least one pole of the first multipole to comprise a different cross-sectional shape than other poles of the first multipole. In certain examples, the method comprises configuring the entry trajectory to be tangential to a first pole of the first multipole. In some embodiments, the method comprises deflecting the ions along the second trajectory using at least one flanking electrode.

In another aspect, a method comprising deflecting ions of a particle beam that enter a first multipole along a first internal trajectory, in which the first internal trajectory is substantially orthogonal to an entry trajectory of the particle beam, and deflecting the deflected ions of the first internal trajectory along a second internal trajectory using the first multipole, in which the second internal trajectory is at a first angle to the first internal trajectory, in which the first angle is greater than zero degrees and less than ninety degrees (positive or negative) is described.

In certain configurations, the method comprises configuring the first multipole with a DC electric field to deflect the ions along the first internal trajectory and the second internal trajectory. In other configurations, the method comprises configuring the first multipole to deflect ions along the second internal trajectory in a substantially antiparallel direction to a direction of the entry trajectory. In some instances, the method comprises configuring the first multipole to deflect the ions along the second internal trajectory in a direction that is substantially parallel to a direction of the entry trajectory. In some embodiments, the method comprises focusing ions exiting the first multipole along the second internal trajectory using at least one lens. In additional examples, the method comprises focusing ions entering the first multipole using a set of electrodes. In other embodiments, the method comprises comprising applying a different direct current voltage to at least one pole of the first multipole, at least two poles of the first multipole, at least three poles of the first multipole or to at least four poles of the first multipole. In some examples, the method comprises configuring at least one pole of the first multipole to comprise a different cross-sectional shape than other poles of the first multipole. In certain examples, the method comprises altering the voltage applied to at least one pole of the first multipole to change the first angle. In some examples, the method comprises deflecting the ions along the second internal trajectory using at least one flanking electrode.

In an additional aspect, a method comprising deflecting ions of a particle beam that enter a first multipole along a first internal trajectory at a first angle to an entry trajectory of the entering particle beam, in which the first angle is different than an angle of the entry trajectory of the entering particle beam, and deflecting the deflected ions of the first internal trajectory along a second internal trajectory at a second angle using the first multipole, in which the second angle of the second internal trajectory is different than the first angle of the first internal trajectory is provided.

In certain examples, the method comprises configuring a DC electric field provided by a first set of electrodes of the first multipole to deflect the ions at the first angle of about ninety degrees (positive or negative). In other examples, the method comprises configuring a DC electric field provided by a second set of electrodes of the first multipole to deflect the ions at the second angle of about ninety degrees (positive or negative). In some embodiments, the method comprises configuring a DC electric field provided by a second set of electrodes of the first multipole to deflect the ions at the second angle of about forty-five degrees (positive or negative). In certain embodiments, the method comprises focusing ions exiting the first multipole along the second internal trajectory using at least one lens. In some examples, the method comprises focusing ions entering the first multipole using a set of electrodes. In certain configurations, the method comprises applying a different direct current voltage to at least one pole of the first multipole, at least two poles of the first multipole, at least three poles of the first multipole or to at least four poles of the first multipole. In some examples, the method comprises configuring at least one pole of the first multipole to comprise a different cross-sectional shape than other poles of the first multipole. In some instances, the method comprises altering the voltage applied to at least one pole of the first multipole to change the first angle or the second angle or both. In other instances, the method comprises deflecting the ions along the second internal trajectory using at least one flanking electrode.

In another aspect, a system comprising a sample introduction device, an ionization source fluidically coupled to the sample introduction device, and a mass analyzer fluidically coupled to the ionization source, in which the mass analyzer comprises a device comprising a first multipole comprising a plurality of electrodes configured to provide a DC electric field effective to direct first ions of an entering particle beam along a first internal trajectory that is substantially orthogonal to an entry trajectory of the particle beam, in which the plurality of electrodes of the first multipole are further configured to direct the directed, first ions along a second internal trajectory that is substantially orthogonal to the first internal trajectory is provided. In some instances, the system may also comprise a detector fluidically coupled to the mass analyzer.

In certain configurations, a first set of poles of the first multipole are configured to direct the first ions along the first internal trajectory, and a second set of poles of the first multipole are configured to direct the first ions along the second internal trajectory. In other configurations, each of the first set and the second set comprises a pair of poles. In some examples, the first set and the second set are each configured to provide the DC electric field using a direct current voltage applied to each electrode of the first multipole. In other examples, the direct current voltage applied to each electrode of the first multipole is a different direct current voltage. In further embodiments, the electrodes are configured to direct the first ions along the second internal trajectory in a direction that is substantially parallel to a direction of the entry trajectory. In additional embodiments, the electrodes are configured to direct the first ions along the second internal trajectory in a direction that is substantially antiparallel to a direction of the entry trajectory. In some examples, the system comprises at least one electrode positioned at an exit aperture of the first multipole. In other examples, the system comprises at least one lens positioned at an exit aperture of the first multipole. In certain examples, the first multipole is configured as a DC quadrupole.

In an additional aspect, a system comprising a sample introduction device, an ionization source fluidically coupled to the sample introduction device, and a ion flow guide fluidically coupled to the ionization source, in which the ion flow guide comprises a device comprising a first multipole comprising a plurality of electrodes configured to provide a DC electric field effective to direct first ions of an entering particle beam along a first internal trajectory that is substantially orthogonal to an entry trajectory of the particle beam, in which the plurality of electrodes of the first multipole are further configured to direct the directed, first ions along a second internal trajectory at a first angle to the directed, first trajectory, in which the first angle of the second internal trajectory is greater than zero degrees and less than ninety degrees (positive of negative) is described. In some instances, the system also comprises a mass analyzer fluidically coupled to the ion flow guide. In some instances, the system also comprises a detector fluidically coupled to the mass analyzer.

In certain instances, a first set of poles of the first multipole are configured to direct the first ions along the first internal trajectory, and a second set of poles of the first multipole are configured to direct the first ions along the second internal trajectory. In an additional aspect, each of the first set and the second set comprises a pair of poles. In some instances, the cross-sectional shape of one pole of the first set of poles and the second set of poles is different. In further embodiments, the first set and the second set are each configured to provide the DC electric field using a direct current voltage applied to each electrode of the first multipole. In other configurations, the direct current voltage applied to each electrode of the first multipole is a different direct current voltage. In certain examples, the electrodes are configured to direct the first ions along the second internal trajectory at about a forty-five degree angle (positive or negative) to the angle of the first internal trajectory. In some examples, the electrodes are configured to direct the first ions along the second internal trajectory at an angle greater than forty-five degrees (positive or negative) to the angle of the first internal trajectory. In some embodiments, the system comprises at least one lens positioned at an exit aperture of the first multipole. In other embodiments, the first multipole is configured as a DC quadrupole.

In an additional aspect, a system comprising a sample introduction device, an ionization source fluidically coupled to the sample introduction device, and a ion flow guide fluidically coupled to the ionization source, in which the ion flow guide comprises a device comprising a first multipole comprising a plurality of electrodes configured to provide a DC electric field effective to direct first ions of an entering particle beam along a first internal trajectory at a first angle different from an angle of the entering particle beam, in which the plurality of electrodes of the first multipole are further configured to direct the directed, first ions along a second internal trajectory at a second angle different than the angle of the first trajectory is provided. In some embodiments, the system comprises a mass analyzer fluidically coupled to the ion flow guide. In some embodiments, the system comprises a detector fluidically coupled to the mass analyzer.

In certain configurations, the first angle is about ninety degrees (positive or negative) from the angle of the entering particle beam. In other examples, the second angle is about ninety degrees (positive or negative) from the first angle. In some examples, the second angle is about forty-five degrees (positive or negative) from the first angle. In certain embodiments, a first set of poles of the first multipole are configured to direct the first ions along the first internal trajectory, and a second set of poles of the first multipole are configured to direct the first ions along the second internal trajectory. In other embodiments, the first set and the second set of poles are each configured to provide the DC electric field using a direct current voltage applied to each electrode of the first multipole. In some embodiments, the cross-sectional shape of at least one pole of the first set is different than a cross-sectional shape of one of the poles of the second set. In certain examples, the system comprises at least one electrode positioned at an exit aperture of the first multipole. In other embodiments, the system comprises at least one lens positioned at an exit aperture of the first multipole. In some instances, the first multipole is configured as a DC quadrupole.

In another aspect, a device comprising a first pole and a second pole together configured to provide a DC electric field effective to direct first ions of an entering particle beam along a first internal trajectory that is substantially orthogonal to an entry trajectory of the particle beam is disclosed. In some instances, the device may comprise a third pole and a fourth pole together configured to provide a DC electric field effective to direct the directed, first ions along a second internal trajectory comprising a second angle different from a first angle of the first internal trajectory. In certain examples, the DC electric field provided by the third and fourth poles is effective to direct the directed, first ions at the second angle of about ninety degrees (positive or negative). In other instances, the DC electric field provided by the third and fourth poles is effective to direct the directed, first ions at the second angle of less than ninety degrees (positive or negative) and greater than zero degrees. In some configurations, the DC electric field provided by the third and fourth poles is effective to direct the directed, first ions at the second angle of about forty-five degrees (positive or negative). In certain examples, the device comprises at least one electrode positioned at an entrance aperture of the first and second poles. In other examples, the device comprises at least one electrode positioned at an exit aperture of the first and second poles. In some examples, the device comprises at least one lens positioned at an exit aperture of the first and second poles.

Additional attributes, features and aspects are described in more detail below.

BRIEF DESCRIPTION OF THE DRAWINGS

Certain features, attributes, configurations and aspects are further described in the detailed description that follows, by reference to the appended drawings by way of non-limiting illustrative embodiments, in which like reference numerals represent similar parts throughout the drawings. As should be understood, however, the devices and methods described herein are not limited to the precise arrangements and instrumentalities depicted in the drawings. In the drawings.

Figure 1A:
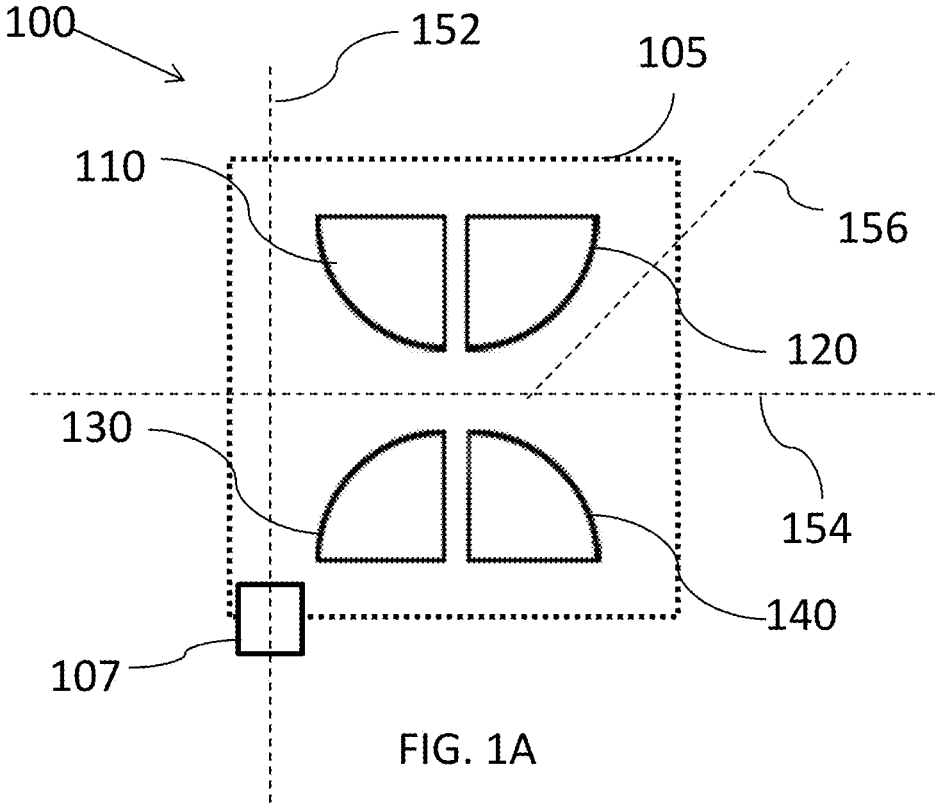
FIGS. 1A and 1B are schematic views of one embodiment of a double bend multipole, in accordance with certain configurations.

Unless otherwise stated herein, no particular sizes, dimensions or geometry is intended to be required for the apertures, electrodes or other structural components of the devices described herein.

DETAILED DESCRIPTION

In the following description, for purposes of explanation and not limitation, specific details are set forth, such as particular electrodes, DC fields, ion trajectory paths, etc. are described in order to illustrate the devices and methods. However, it will be apparent to one skilled in the art, given the benefit of this disclosure, that the devices and methods may be practiced in other embodiments that depart from these specific details. Detailed descriptions of well-known signals, circuits, thresholds, components, particles, particle streams, operation modes, techniques, protocols, and hardware arrangements, either internal or external, electrodes, frequencies, etc., are omitted so as not to obscure the description. In certain embodiments, the DC fields described herein may be considered static fields in that the applied voltages generally do not change, e.g., are substantially constant, during guidance of the ions entering into and/or exiting the devices.

As described in more detail below, a single multipole can be used to provide for two different static fields that can doubly bend the ions in an entering particle beam in multiple different directions within the single multipole. In some configurations, by double bending of the ions using a first multipole, photons and/or other unwanted species in an entering particle beam can be removed from a beam that exits the first multipole. Double bending using a single multipole can also simplify the system configuration. In certain embodiments, the use of a single multipole to doubly bend ions may provide for better removal of photons which are emitted from metastable species, e.g., metastable argon. For example, energy in a typical deflector can create collisions between argon and ions creating metastable argon, which can emit photons as they relax. Doubly bending using a single multipole can minimize the metastable emission that interferes with the signal to be detected and reduces the overall length of the ion optics While certain bend angles and voltage parameters to provide such bend angles are described below, the exact angle of the bending may vary and illustrative angles are described herein. Where a particular angle is specified, the angle need not be exactly the same as what is specified but may instead vary, for example, from a few degrees (1-2 degrees) up to about five degrees. Where angles are described, the angle may be positive or negative from a reference trajectory path. It will be recognized by the person of ordinary skill in the art, given the benefit of this disclosure, that the voltage parameters used to provide a desired double bend may be altered depending on the ion energies, the pressures in the system and/or the level of interfering species present in an ion beam.

In certain configurations, the methods and devices described herein can be effective to direct ions along a desired path, e.g., a desired internal path or paths within a multipole. In addition to other applications, the example embodiments described herein may be utilized with a mass spectrometer prior to ion beam introduction into a reaction cell, collision cell and/or mass analyzer to separate ions of interest from other elements that may coexist within a particle stream provided by the ion source. In some instances, the devices comprise four multipoles which can be configured to function together to doubly bend an ion beam or can function as sets of poles, e.g., 2 sets of poles, depending on the exact pole geometry and applied voltages.

Figure 1B:
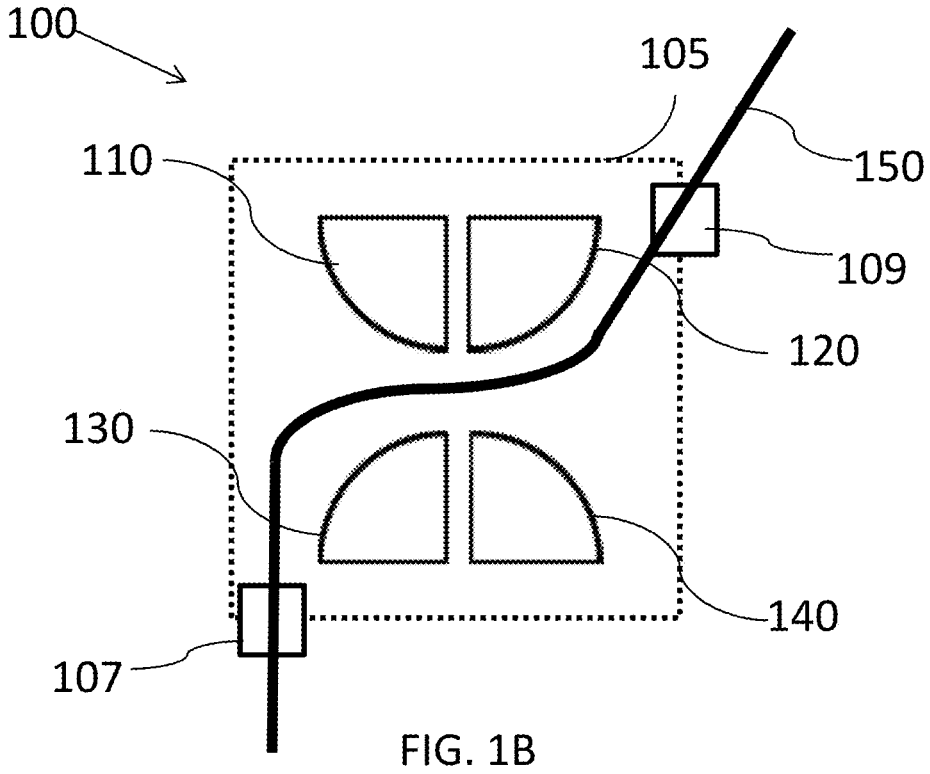

In certain configurations and referring to FIG. 1A, a multipole 100 comprises poles 110-140 arranged in a quadrupole configuration within a housing 105. The housing 105 may comprise an entrance port 107 to permit a beam (not shown in FIG. 1A), e.g., a beam with ions and/or photons or articles, to enter into the housing along a first trajectory path 152, which is generally tangential to the first pole 110 of the first multipole 100. When the beam encounters the poles 110-140, it is first bent in a direction to place the beam trajectory along the path 154. After the ions have been bent to travel along the trajectory 154. The poles 110-140 are also effective to bend the beam along a second internal path 154 in a second direction along a third trajectory 156 where the beam would typically exit the housing 105 through an exit aperture 109. The overall path of the ion beam 150 within the multipole 100 is shown in FIG. 1B where the paths 152, 154 and 156 have been removed for clarity. If the entry path 152 is considered to be a zero angle, then the beam 150 is bent first by about 90 degrees from the path 152 to the path 154. The beam is then bent by about −45 degrees from the path 154 to the path 156. Suitable voltages can be applied to each of the multipoles 110-140 to provide such double bending of the beam 150 within the multipole 100. In some instances, the voltage applied to at least two of the multipoles 110-140 is a DC voltage to provide a DC field between the two multipoles. In other instances, the voltage applied to at least three of the multipoles 110-140 is a DC voltage to provide a DC field between the three multipoles. In other configurations, the voltage applied to all four of the multipoles 110-140 is a DC voltage to provide a DC field between the four multipoles. In some embodiments, during the double bending operation it may be desirable to maintain the voltages at a fixed voltage, e.g., a fixed or static DC voltage that does not change to a substantial degree during the double bending of the beam 150. Illustrative DC voltages for doubly bending a beam 150 in the manner shown in FIGS. 1A and 1B can vary. In some instances, the DC voltage applied to the pole 110 may be about −20 Volts DC+/−20 Volts DC, the voltage applied to the pole 120 may be about −103 Volts DC+/−20 Volts DC, the voltage applied to the pole 130 may be about −130 Volts DC+/−20 Volts DC, and the voltage applied to the pole 140 may be about −30 Volts DC+/−20 Volts DC. As noted herein, however, the exact voltage applied to any particular pole can vary with the desired bend angle(s) and/or the particular pole geometry used. In addition, where the voltage applied to one of the multipoles 110-140 changes from the illustrative values listed herein, it may be desirable to alter the voltages applied to the other poles to provide for a desired double bend.

Figure 2A:
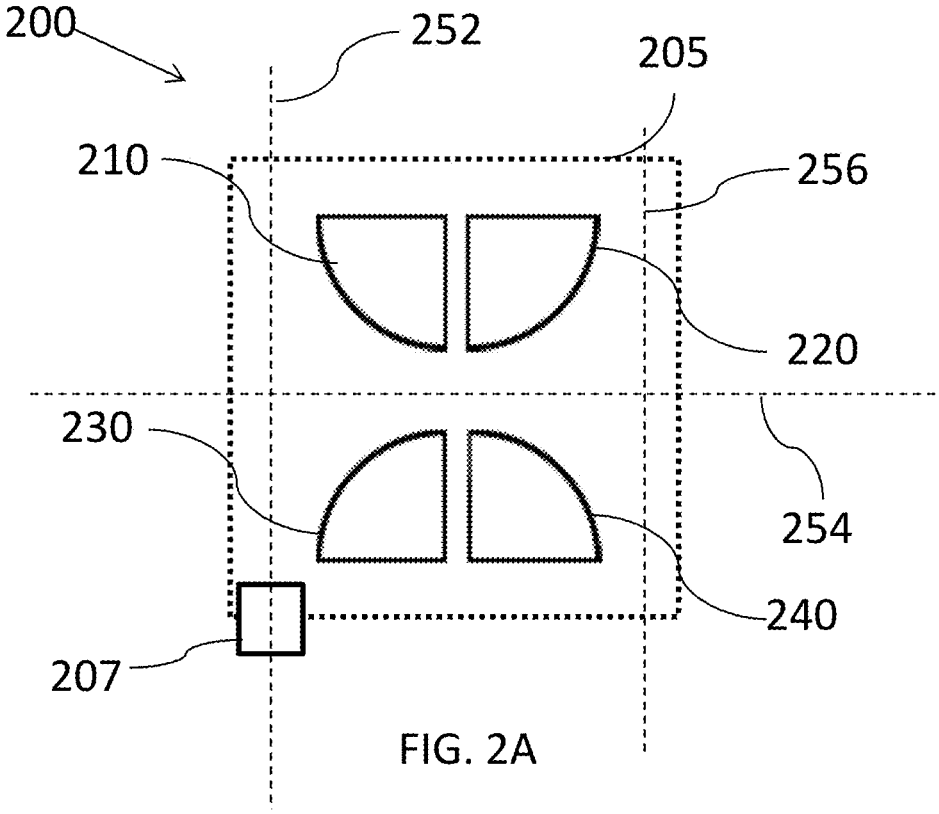
FIGS. 2A and 2B are schematic views of another embodiment of a double bend multipole, in accordance with certain configurations.
Figure 2B:
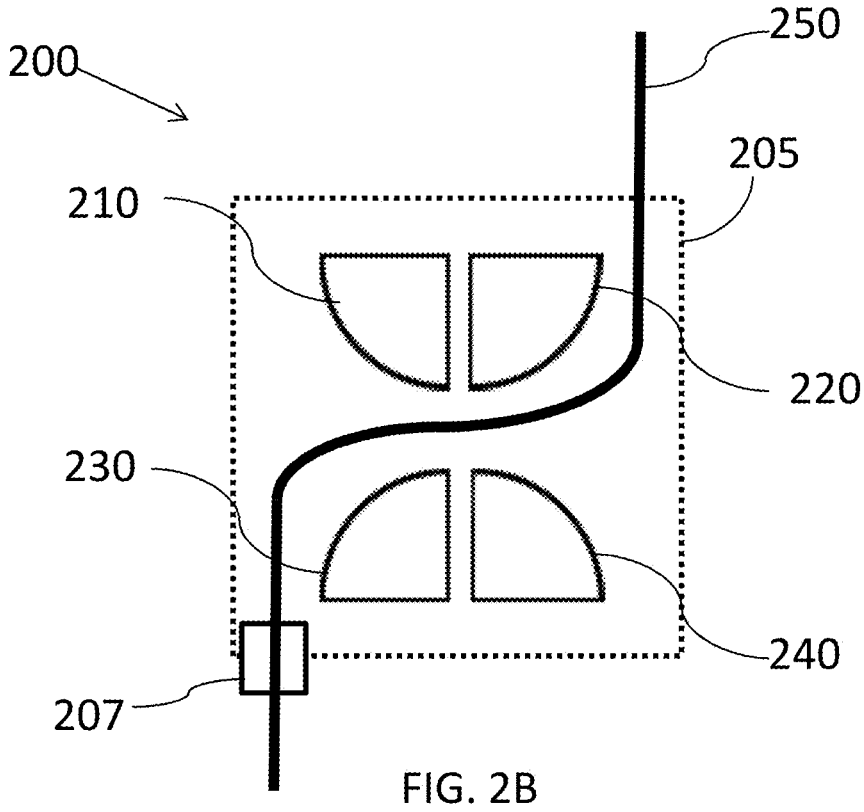

In certain embodiments, it may be desirable to doubly bend an ion beam in a 90/−90 configuration. Referring to FIG. 2A, a multipole 200 comprises poles 210-240 arranged in a quadrupole configuration within a housing 205. The housing 205 may comprise an entrance port 207 to permit a beam (not shown in FIG. 2A), e.g., a beam comprising ions and/or photos or particles, to enter into the housing along a first trajectory path 252. When the beam encounters the poles 210-240, it is first bent in a direction to place the ion beam trajectory along the path 254. The poles 210-240 are effective to bend the beam along the path 254 in a second direction along a third trajectory 256 where the beam would typically exit the housing 205 through an exit aperture (not shown). The overall path of the beam 250 within the multipole 200 is shown in FIG. 2B where the paths 252, 254 and 256 have been removed for clarity. If the entry path 252 is considered to be a zero angle, then the beam 250 is bent first by about 90 degrees from the path 252 to the path 254. The beam is then bent by about −90 degrees from the path 254 to the path 256. Suitable voltages can be applied to each of the multipoles 210-240 to provide such 90/−90 double bending of the ion beam 250 within the multipole 200. In some instances, the voltage applied to at least two of the multipoles 210-240 is a DC voltage to provide a DC field between the two multipoles. In other instances, the voltage applied to at least three of the multipoles 210-240 is a DC voltage to provide a DC field between the three multipoles. In other configurations, the voltage applied to all four of the multipoles 210-240 is a DC voltage to provide a DC field between the four multipoles. In some embodiments, during the double bending operation it may be desirable to maintain the voltages at a fixed voltage, e.g., a fixed or static DC voltage that does not change to a substantial degree during the double bending of the beam 250. Illustrative DC voltages for doubly bending a beam 250 in the manner shown in FIGS. 2A and 2B can vary. In some instances, the DC voltage applied to the pole 210 may be about −20 Volts DC+/−20 Volts DC, the voltage applied to the pole 220 may be about −200 Volts DC+/−20 Volts DC, the voltage applied to the pole 230 may be about −150 Volts DC+/−20 Volts DC, and the voltage applied to the pole 240 may be about −40 Volts DC+/−20 Volts DC. As noted herein, however, the exact voltage applied to any particular pole can vary with the desired bend angle(s) and/or the particular pole geometry used. In addition, where the voltage applied to one of the multipoles 210-240 changes from the illustrative values listed herein, it may be desirable to alter the voltages applied to the other poles to provide for a desired double bend.

Figure 3A:
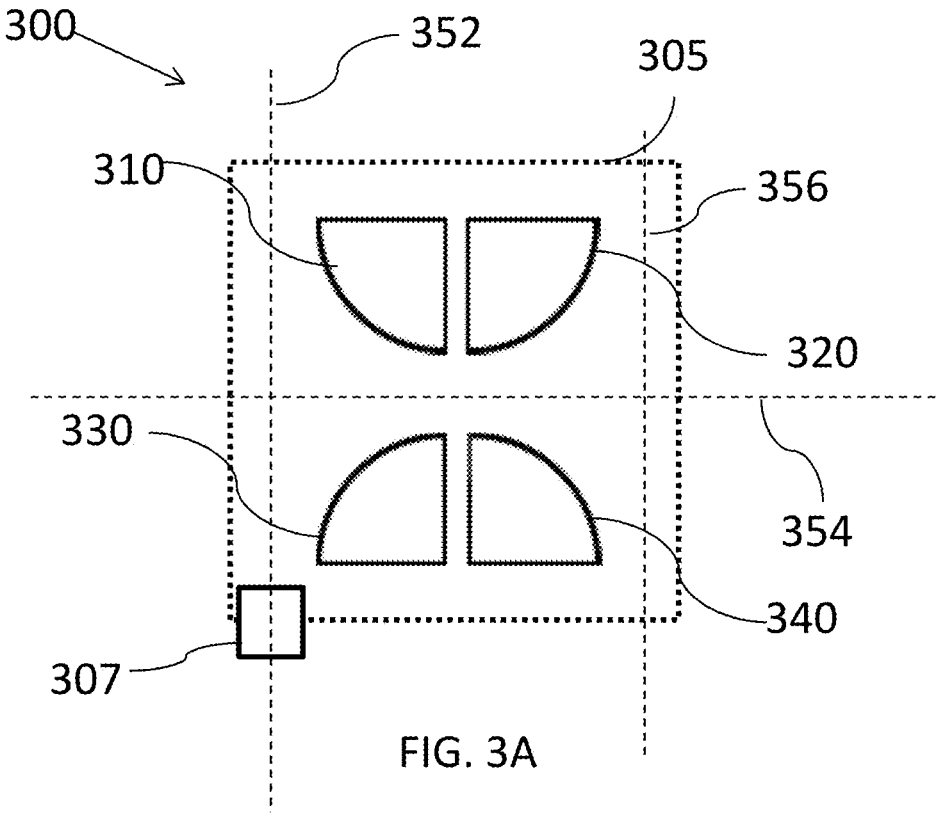
FIGS. 3A and 3B are schematic views of another embodiment of a double bend multipole, in accordance with certain configurations.
Figure 3B:
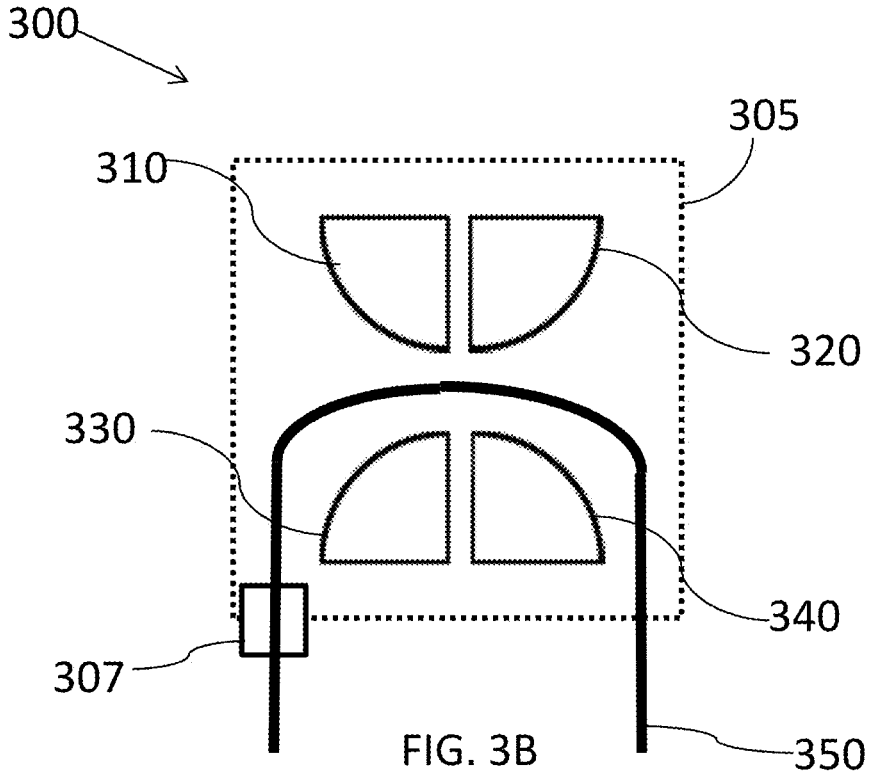

In certain configurations, it may be desirable to doubly bend an ion beam in a 90/90 configuration. Referring to FIG. 3A, a multipole 300 comprises poles 310-340 arranged in a quadrupole configuration within a housing 305. The housing 305 may comprise an entrance port 307 to permit a beam (not shown in FIG. 3A) to enter into the housing along a first trajectory path 352. When the beam encounters the poles 310-340, it is first bent in a direction to place the ion beam trajectory along the path 354. The poles 310-340 are effective to bend the beam along the path 354 in a second direction along a third trajectory 356 where the beam would typically exit the housing 305 through an exit aperture (not shown). The overall path of the beam 350 within the multipole 300 is shown in FIG. 3B where the paths 352, 354 and 356 have been removed for clarity. If the entry path 352 is considered to be a zero angle, then the beam 350 is bent first by about 90 degrees from the path 352 to the path 354. The beam is then bent by about +90 degrees from the path 354 to the path 356. Suitable voltages can be applied to each of the multipoles 310-340 to provide such 90/90 double bending of the ion beam 350. In some instances, the voltage applied to at least two of the multipoles 310-340 is a DC voltage to provide a DC field between the two multipoles. In other instances, the voltage applied to at least three of the multipoles 310-340 is a DC voltage to provide a DC field between the three multipoles. In other configurations, the voltage applied to all four of the multipoles 310-340 is a DC voltage to provide a DC field between the four multipoles. In some embodiments, during the double bending operation it may be desirable to maintain the voltages at a fixed voltage, e.g., a fixed or static DC voltage that does not change to a substantial degree during the double bending of the ion beam 350. Illustrative DC voltages for doubly bending a beam 350 in the manner shown in FIGS. 3A and 3B can vary. In some instances, the DC voltage applied to the pole 310 may be about −20 Volts DC+/−20 Volts DC, the voltage applied to the pole 320 may be about −40 Volts DC+/−20 Volts DC, the voltage applied to the pole 330 may be about −150 Volts DC+/−20 Volts DC, and the voltage applied to the pole 340 may be about −200 Volts DC+/−20 Volts DC. The exact voltage applied to any particular pole can vary with the desired bend angle(s) and/or the particular pole geometry used and the ion energies, pressure in the ion flow guides and other factors. In some configurations, the voltage applied to poles 310 and 330 may be substantially the same. In addition, where the voltage applied to one of the multipoles 310-340 changes from the illustrative values listed herein, it may be desirable to alter the voltages applied to the other poles to provide for a desired double bend in the manner shown in FIG. 3B.

Figure 4A:
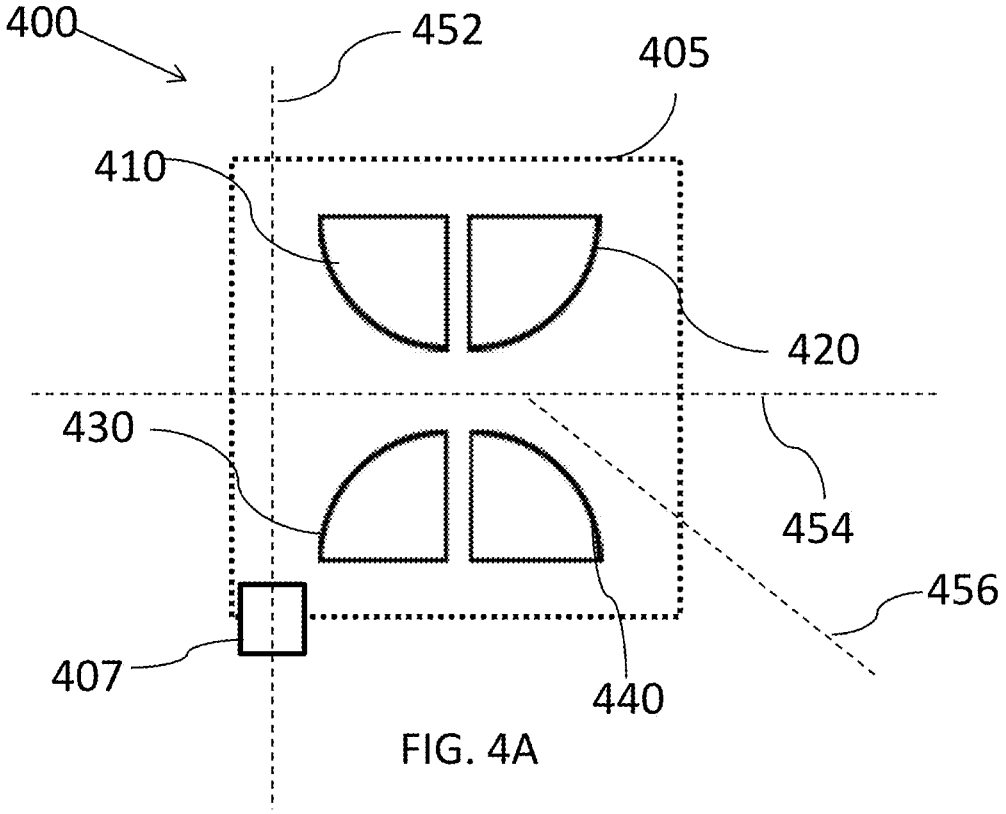
FIGS. 4A and 4B are schematic views of another embodiment of a double bend multipole, in accordance with certain configurations.
Figure 4B:
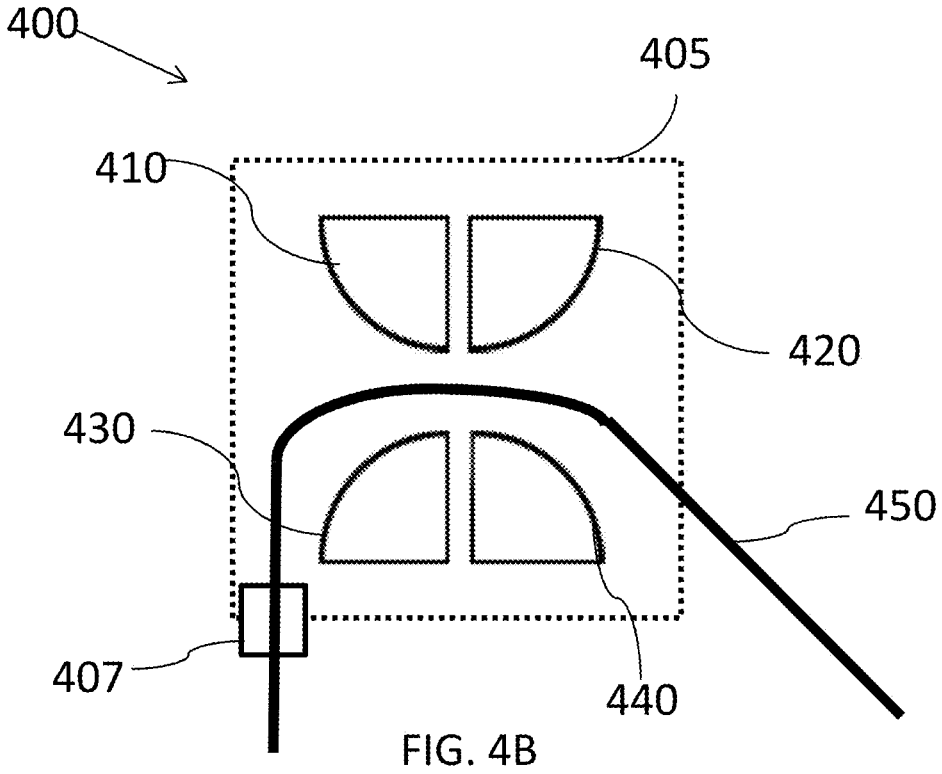

In some embodiments, it may be desirable to doubly bend an ion beam in a 90/45 configuration. Referring to FIG. 4A, a multipole 400 comprises poles 410-440 arranged in a quadrupole configuration within a housing 405. The housing 405 may comprise an entrance port 407 to permit a beam (not shown in FIG. 4A) to enter into the housing along a first trajectory path 452. When the beam encounters the poles 410-440, it is first bent in a direction to place the ion beam trajectory along the path 454. The poles 410-440 are effective to bend the beam along the path 454 in a second direction along a third trajectory 456 where the beam would typically exit the housing 405 through an exit aperture (not shown). The overall path of the ion beam 450 within the multipole 400 is shown in FIG. 4B where the paths 452, 454 and 456 have been removed for clarity. If the entry path 452 is considered to be a zero angle, then the beam 450 is bent first by about 90 degrees from the path 452 to the path 454. The beam is then bent by about +45 degrees from the path 454 to the path 456. Suitable voltages can be applied to each of the multipoles 410-440 to provide such 90/45 double bending of the ion beam 450. In some instances, the voltage applied to at least two of the multipoles 410-440 is a DC voltage to provide a DC field between the two multipoles. In other instances, the voltage applied to at least three of the multipoles 410-440 is a DC voltage to provide a DC field between the three multipoles. In other configurations, the voltage applied to all four of the multipoles 410-440 is a DC voltage to provide a DC field between the four multipoles. In some embodiments, during the double bending operation it may be desirable to maintain the voltages at a fixed voltage, e.g., a fixed or static DC voltage that does not change to a substantial degree during the double bending of the beam 450. Illustrative DC voltages for doubly bending a beam 450 in the manner shown in FIGS. 4A and 4B can vary. In some instances, the DC voltage applied to the pole 410 may be about −20 Volts DC+/−20 Volts DC, the voltage applied to the pole 420 may be about −30 Volts DC+/−20 Volts DC, the voltage applied to the pole 430 may be about −130 Volts DC+/−20 Volts DC, and the voltage applied to the pole 440 may be about −103 Volts DC+/−20 Volts DC. The exact voltage applied to any particular pole can vary with the desired bend angle(s) and/or the particular pole geometry used. In addition, where the voltage applied to one of the multipoles 410-440 changes from the illustrative values listed herein, it may be desirable to alter the voltages applied to the other poles to provide for a desired double bend in the manner shown in FIG. 4B.

In certain embodiments, the ion beam need not be bent at 90 degrees (positive or negative) or 45 degrees (positive or negative). In particular, the various poles and their applied voltages can be selected to bend the beams at any angle between 0 degrees and 90 degrees (relative to the angle of a current path of an ion beam). For example, the beam can be bent by about +10 degrees, about +15 degrees, about +20 degrees, about +25 degrees, about +30 degrees, about +35 degrees, about +40 degrees, about +45 degrees, about +50 degrees, about +55 degrees, about +60 degrees, about +65 degrees, about +70 degrees, about +75 degrees, about +80 degrees, about +85 degrees or about +90 degrees. In other instances, the beam can be bent by about −10 degrees, about −15 degrees, about −20 degrees, about −25 degrees, about −30 degrees, about −35 degrees, about −40 degrees, about −45 degrees, about −50 degrees, about −55 degrees, about −60 degrees, about −65 degrees, about −70 degrees, about −75 degrees, about −80 degrees, about −85 degrees or about −90 degrees. To alter the bend angle, the voltage applied to one or more of the multipoles can be altered or the pole geometry can be altered or both the pole geometry and the applied voltage can be altered. For example and referring to FIG. 5, a multipole 500 is shown where the pole geometry, e.g., cross-sectional shape, of a pole 510 differs from that of the poles 520-540. The electrodes/poles 520-540 have inward facing curved surfaces and a configuration corresponding to a quarter of a cylinder, whereas electrode 510 comprises an inward facing curved surface and corresponds generally to ⅛ of a cylinder. In some embodiments, the inward facing curved surfaces may aid in deflecting ions along desired orthogonal trajectories. Depending on the desired path, electrodes having other configurations (e.g., other surfaces, shapes, etc.) may be utilized in combination with or in the alternative to curved surfaces. For example, all or a portion of the electrodes may have inward facing surfaces with a hyperbolic curvature. All or a portion of the electrodes, alternatively, may have inward facing flat surfaces set at appropriate angles to achieve deflection along the desired path. The housing 505 may comprise an entrance port 507 to permit a beam (not shown) to enter into the housing along a first trajectory path 552. When the beam encounters the poles 510, 530, it is first bent in a direction to place the beam trajectory along the path 554. The poles 520, 540 are effective to bend the ions along the path 554 in a second direction along a third trajectory 556 where the beam would typically exit the housing 505 through an exit aperture (not shown). If the entry path 552 is considered to be a zero angle, then the ion beam entering the housing 505 is bent first by about 90 degrees from the path 552 to the path 554. The beam is then bent by about −45 degrees from the path 554 to the path 556. Suitable voltages can be applied to each of the multipoles 510-540 to provide such 90/−45 double bending of the beam. In some instances, the voltage applied to at least two of the multipoles 510-540 is a DC voltage to provide a DC field between the two multipoles. In other instances, the voltage applied to at least three of the multipoles 510-540 is a DC voltage to provide a DC field between the three multipoles. In other configurations, the voltage applied to all four of the multipoles 510-540 is a DC voltage to provide a DC field between the four multipoles. In some embodiments, during the double bending operation it may be desirable to maintain the voltages at a fixed voltage, e.g., a fixed or static DC voltage that does not change to a substantial degree during the double bending of the ion beam. Illustrative DC voltages for doubly bending an ion beam in a 90/−45 manner using the multipole 500 can vary. In some instances, the DC voltage applied to the pole 510 may be about −20 Volts DC+/−20 Volts DC, the voltage applied to the pole 520 may be about −102 Volts DC +/−20 Volts DC, the voltage applied to the pole 530 may be about −130 Volts DC+/−20 Volts DC, and the voltage applied to the pole 540 may be about −30 Volts DC+/−20 Volts DC. The exact voltage applied to any particular pole can vary with the desired bend angle(s) and/or the particular pole geometry used. In addition, where the voltage applied to one of the multipoles 510-540 changes from the illustrative values listed herein, it may be desirable to alter the voltages applied to the other poles to provide for a desired double bend in the manner shown in FIG. 5.

Figure 6:
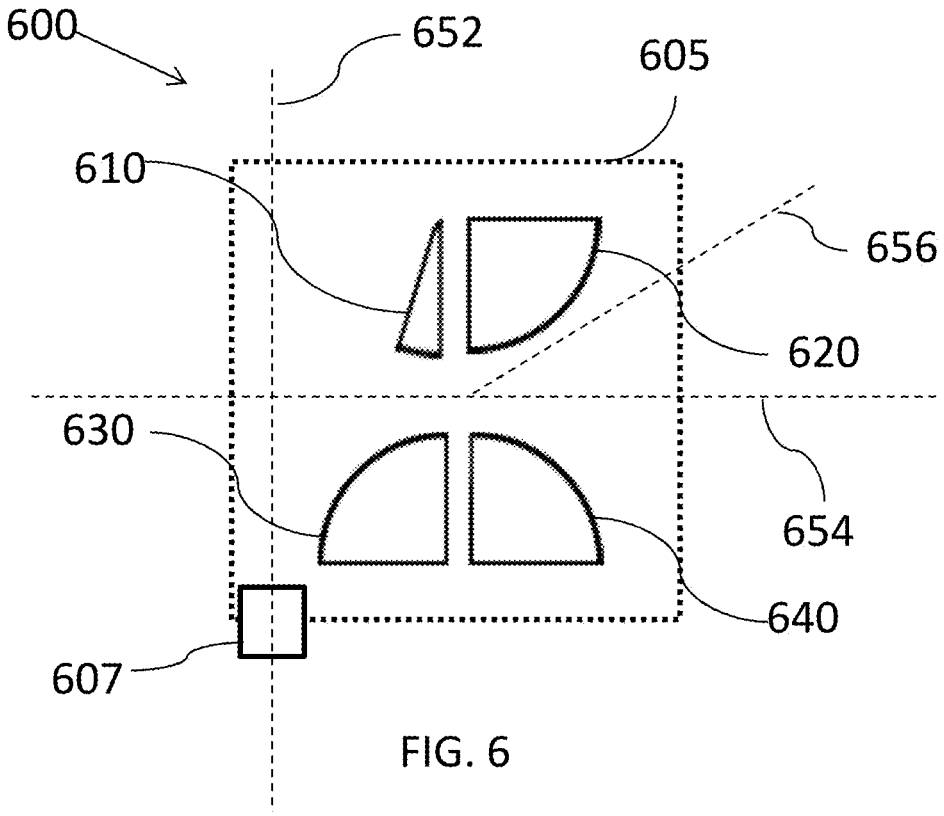
FIG. 6 is another illustration of an embodiment of a double bend multipole where the geometry of one multipole is different than the geometry of another multipole, in accordance with certain configurations.

In another configuration, a multipole 600 where one multipole has a geometry, e.g., cross-sectional shape, different than that of the pole 510 is shown in FIG. 6. The multipole 600 comprises a pole 610 whose geometry differs from that of pole 510 and poles 620-640 The electrodes/poles 620-640 have inward facing curved surfaces and a configuration corresponding to a quarter of a cylinder, whereas electrode 610 comprises an inward facing curved surface and corresponds generally to 1/16 of a cylinder. The housing 605 may comprise an entrance port 607 to permit an ion beam (not shown) to enter into the housing along a first trajectory path 652. When the beam encounters the poles 610, 630, it is first bent in a direction to place the beam trajectory along the path 654. The poles 620, 640 are effective to bend the beam along the path 654 in a second direction along a third trajectory 656 where the beam would typically exit the housing 605 through an exit aperture (not shown). If the entry path 652 is considered to be a zero angle, then the ion beam entering the housing 605 is bent first by about 90 degrees from the path 652 to the path 654. The beam is then bent by about negative 25 degrees from the path 654 to the path 656. Suitable voltages can be applied to each of the multipoles 610-640 to provide such 90/−25 double bending of the ion beam. In some instances, the voltage applied to at least two of the multipoles 610-640 is a DC voltage to provide a DC field between the two multipoles. In other instances, the voltage applied to at least three of the multipoles 610-640 is a DC voltage to provide a DC field between the three multipoles. In other configurations, the voltage applied to all four of the multipoles 610-640 is a DC voltage to provide a DC field between the four multipoles. In some embodiments, during the double bending operation it may be desirable to maintain the voltages at a fixed voltage, e.g., a fixed or static DC voltage that does not change to a substantial degree during the double bending of the ion beam. Illustrative DC voltages for doubly bending a beam in a 90/−25 manner using the multipole 600 can vary. In some instances, the DC voltage applied to the pole 610 may be about −20 Volts DC+/−20 Volts DC, the voltage applied to the pole 620 may be about −99 Volts DC+/−20 Volts DC, the voltage applied to the pole 630 may be about −130 Volts DC+/−20 Volts DC, and the voltage applied to the pole 640 may be about −30 Volts DC+/−20 Volts DC. The exact voltage applied to any particular pole can vary with the desired bend angle(s) and/or the particular pole geometry used. In addition, where the voltage applied to one of the multipoles 610-640 changes from the illustrative values listed herein, it may be desirable to alter the voltages applied to the other poles to provide for a desired double bend in the manner shown in FIG. 6.

Figure 5:
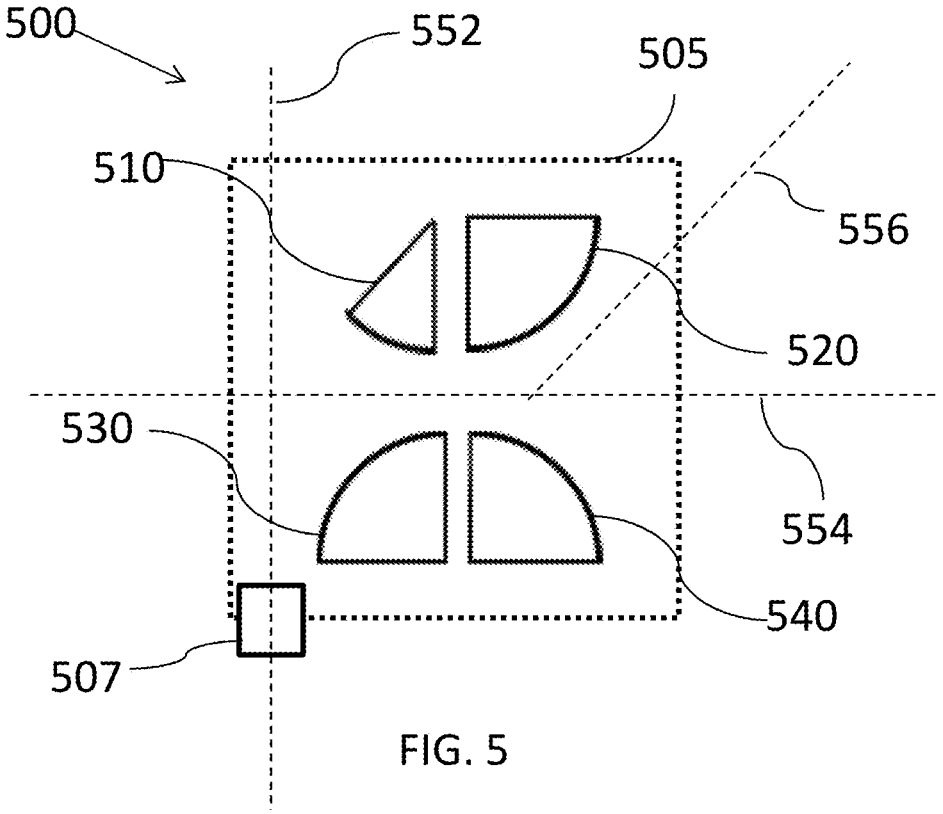
FIG. 5 is an illustration of an embodiment of a double bend multipole where the geometry of one multipole is different than the geometry of another multipole, in accordance with certain configurations.
Figure 7:
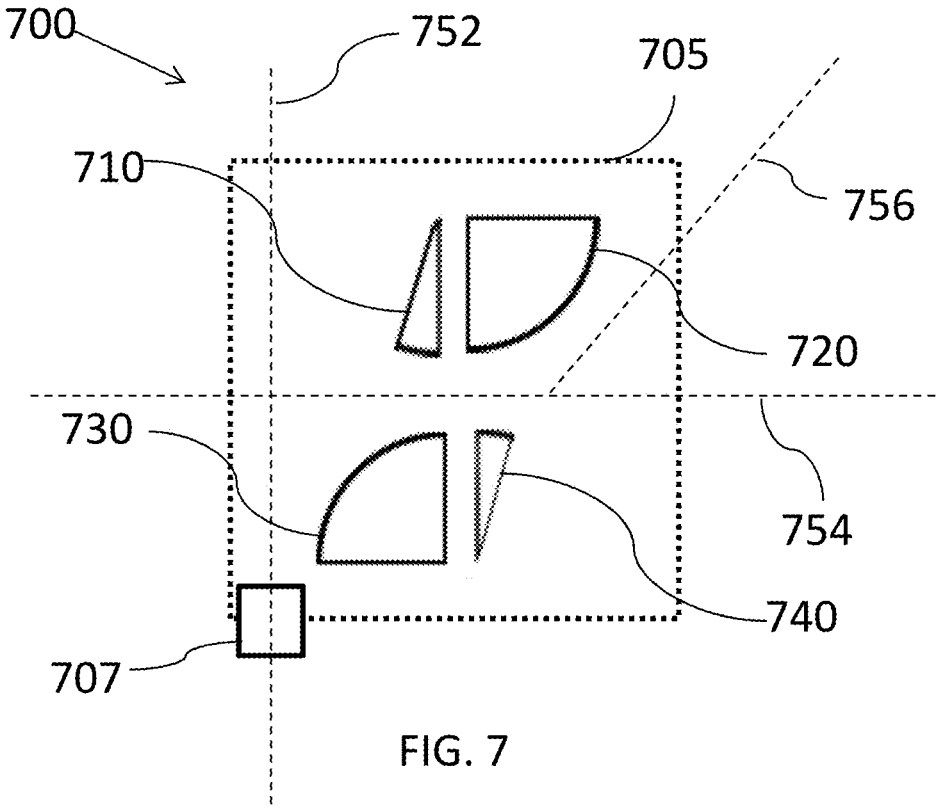
FIG. 7 is an illustration of an embodiment of a double bend multipole where the geometry of two multipoles are different, in accordance with certain configurations.

In certain configurations, while FIGS. 5 and 6 show multipoles where the geometry of only one pole differs from the other three poles, it may be desirable to vary the geometry of more than one pole in the multipole. Referring to FIG. 7, a multipole 700 is shown comprising multipoles 710-740. The geometry of poles 710, 740 differs from that of poles 720, 730. The electrodes/poles 720, 730 have inward facing curved surfaces and a configuration corresponding to a quarter of a cylinder, whereas electrodes 710, 740 comprise inward facing curved surfaces and correspond generally to 1/16 of a cylinder. The housing 705 may comprise an entrance port 707 to permit a beam (not shown) to enter into the housing along a first trajectory path 752. When the beam encounters the poles 710-740, it is first bent in a direction to place the beam trajectory along the path 754. The poles 710-740 are effective to bend the beam along the path 754 in a second direction along a third trajectory 756 where the beam would typically exit the housing 705 through an exit aperture (not shown). If the entry path 752 is considered to be a zero angle, then the ion beam entering the housing 705 is bent first by about 90 degrees from the path 752 to the path 754. The beam is then bent by about −45 degrees from the path 754 to the path 756. Suitable voltages can be applied to each of the multipoles 710-740 to provide such 90/−45 double bending of the ion beam. In some instances, the voltage applied to at least two of the multipoles 710-740 is a DC voltage to provide a DC field between the two multipoles. In other instances, the voltage applied to at least three of the multipoles 710-740 is a DC voltage to provide a DC field between the three multipoles. In other configurations, the voltage applied to all four of the multipoles 710-740 is a DC voltage to provide a DC field between the four multipoles. In some embodiments, during the double bending operation it may be desirable to maintain the voltages at a fixed voltage, e.g., a fixed or static DC voltage that does not change to a substantial degree during the double bending of the ion beam. Illustrative DC voltages for doubly bending a beam in a 90/−45 manner using the multipole 700 can vary. In some instances, the DC voltage applied to the pole 710 may be about −20 Volts DC+/−20 Volts DC, the voltage applied to the pole 720 may be about −101 Volts DC+/−20 Volts DC, the voltage applied to the pole 730 may be about −130 Volts DC+/−20 Volts DC, and the voltage applied to the pole 740 may be about −30 Volts DC+/−20 Volts DC. The exact voltage applied to any particular pole can vary with the desired bend angle(s) and/or the particular pole geometry used. In addition, where the voltage applied to one of the multipoles 710-740 changes from the illustrative values listed herein, it may be desirable to alter the voltages applied to the other poles to provide for a desired double bend in the manner shown in FIG.7.

In certain configurations, the poles shown in FIGS. 1A-7 are generally arranged in a quadrupole manner. For example, a DC quadrupole can be provided by applying a direct current voltage to a plurality of poles/electrodes. In some instances, a direct current voltage may be applied in the absence of any radio frequencies. For example, only the direct current voltage is applied, e.g., no radio frequency signal or energy is provided to the electrodes used to provide the DC field. It should be noted again that paths depicted in the figures represent approximations and the actual paths taken by any ion deflected may vary based on numerous factors such as, for example, the strength of the electric field. Nonetheless, the depicted paths provide a useful tool for discussion concerning the operation of certain embodiments. The path that the ions are directed along by the DC electric fields provided by quadrupoles may vary depending upon the intended application of the deflectors. In addition to other applications, the double deflection within a single multipole may have utility for separating ions to be analyzed from photons, neutrals, oppositely charged ions and/or other additional elements that may be present within the particle stream. As a particle stream provided from a source passes through an aperture into space between the poles, the DC quadrupole electric field provided by applying DC voltages to the different poles/electrodes of quadrupole will doubly deflect or direct ions within the stream. The doubly deflected ions will thus exit the first DC quadrupole and may be provided to another device downstream of the first DC quadrupole, e.g., a detector or other component. Photons and neutrals, however, within the particle stream may be unaffected by the field provided by DC quadrupole and may exit the DC quadrupole at an angle that is different from the exit angle of the ion beam. The double deflection of ions passing through common space created by positioning of the poles within the DC quadrupole can be effective to separate ions to be detected from neutrals, photons and/or other elements within the particle stream.

Figure 8:
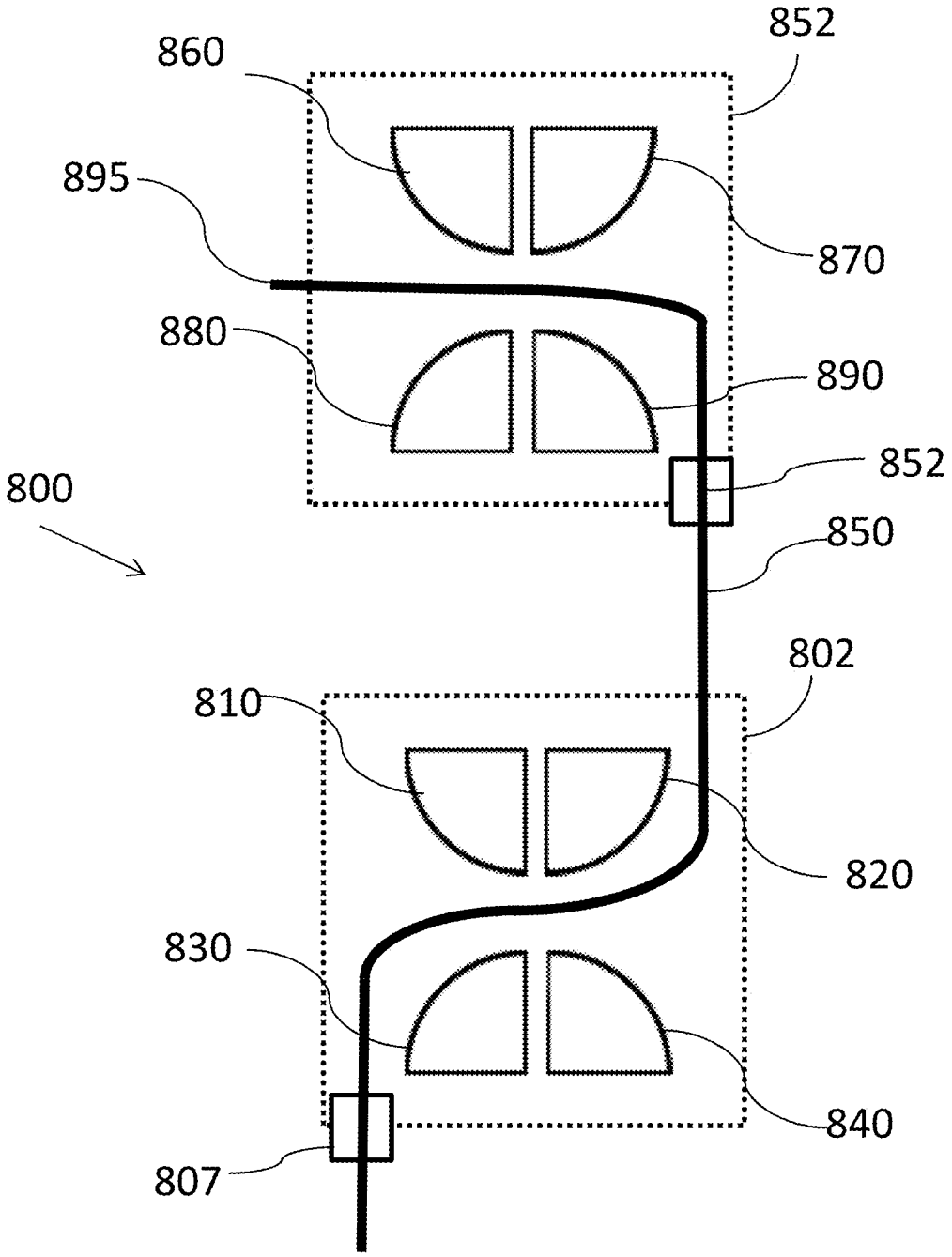
FIG. 8 is an illustration of double bend multipole fluidically coupled to a single bend multipole, in accordance with certain configurations.

In instances where a double deflection within a DC quadrupole is not enough to remove unwanted species from an ion beam, a second DC quadrupole can be fluidically coupled to the first DC quadrupole. For example, for certain samples even a double bend within a first DC multipole may permit undesired species within the particle stream to remain in the stream that exits the first DC multipole. More specifically, a portion of the undesired elements within the particle stream may diffuse, scatter, and/or otherwise follow the ions to be analyzed that exit the first DC multipole. Deflecting the existing particle stream a third time as they pass through the DC quadrupole field of a second DC multipole may further reduce the number the undesired elements that enter the detector (not shown). For example, a second DC quadrupole effective to provide a single bend of an ion beam may be fluidically coupled to a first DC quadrupole effective to doubly bend an ion beam within the first DC quadrupole. The end result of such a configuration is three total bends of the ion beam with two bends within the first DC multipole and the third bend within the second DC multipole. Referring to FIG. 8, a system 800 is shown comprising a double bend multipole 802 comprising poles 810-840. A beam enters the first multipole 802 through an aperture 807, is doubly bent by the poles 810-840 and exits the first multipole 802 at an exit trajectory 850 through an exit aperture (not shown) of the first multipole 802. While the exit trajectory 850 is shown for illustration purposes as being provided from a 90/−90 bend, other bend angles are possible as described herein, e.g., 90/−45 bend, 90/−25 bend, 90/90 bend, etc. The beam 850 then enters a second multipole 852 comprising poles 860-890 through an aperture 857 in a housing of the second multipole 852. If desired, the first multipole 802 and the second multipole 852 can be present in a common housing. The poles 860-890 are effective to singly bend the beam in a direction substantially orthogonal to the entry trajectory through the aperture 857. Examples of single bend multipoles can be found, for example, in commonly assigned U.S. application Ser. No. 14/060,120, the entire disclosure of which is hereby incorporated herein by reference for all purposes. The beam then exits the second multipole 852 in a direction generally along path 895 through an exit aperture (not shown) of the multipole 852. By bending the beam more than twice using two separate multipoles where one of the multipoles is a double bend multipole, it may be possible to get better separation between interfering species from desired ions of interest.

Figure 9:
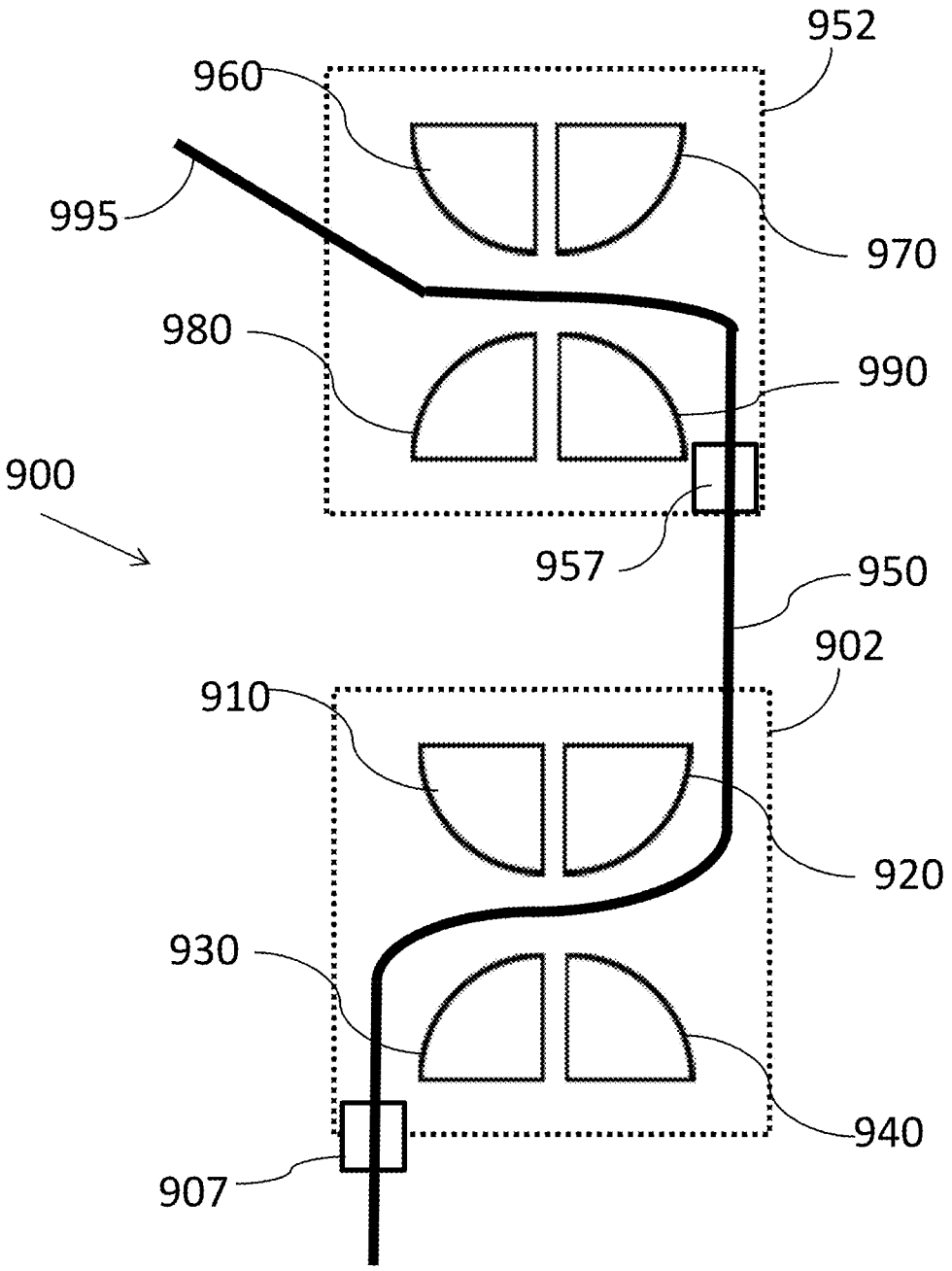
FIG. 9 is an illustration of two double bend multipoles fluidically coupled to each other, in accordance with certain configurations.

In other configurations, it may be desirable to fluidically couple two or more DC quadrupoles each configured to doubly bend an ion beam within each quadrupole. The effect of doubly bending the ion beam using two different DC quadrupoles provides a change in trajectory of at least four different angles, e.g., four total bends. By increasing the number of trajectory changes, more effective separation of unwanted species in an ion beam from the desired ions of interest may be achieved. Referring to FIG. 9, a system 800 is shown comprising a double bend multipole 902 comprising poles 910-940. A beam enters the first multipole 902 through an aperture 907, is doubly bent by the poles 910-940 and exits the first multipole 902 at an exit trajectory 950 through an exit aperture (not shown) of the first multipole 902. While the exit trajectory 950 is shown for illustration purposes as being provided from a 90/−90 bend, other bend angles are possible as described herein, e.g., 90/−45 bend, 90/−25 bend, 90/90 bend, etc. The beam 950 then enters a second double bend multipole 952 comprising poles 960-990 through an aperture 957 in a housing of the second multipole 952. If desired, the first multipole 902 and the second multipole 952 can be present in a common housing. The poles 960-990 are effective to doubly bend the beam in a direction, e.g., providing a −90/+45 bend. The beam then exits the second multipole 952 in a direction generally along path 995 through an exit aperture (not shown) of the multipole 952. By bending the beam more than three times using two separate double bend multipoles, it may be possible to get better separation between interfering species from desired ions of interest.

Figure 10:
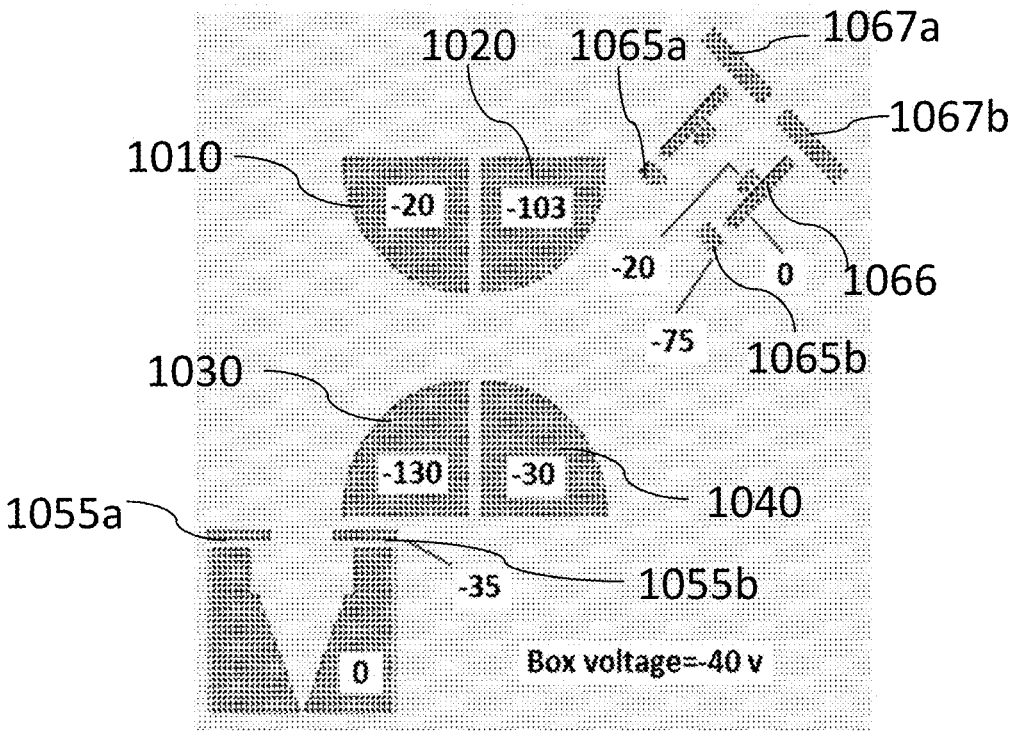
FIG. 10 is an illustration of a multipole with electrodes positioned near entrance and exit apertures of the multipole, in accordance with certain configurations.

In certain configurations, it may be desirable to use one or more entrance electrodes and/or entrance lenses to focus the beam prior to entry into the multipole. In other instances, it may be desirable to use one or more exit electrodes and/or entrance lenses to focus the beam after the beam exits the multipole. In additional configurations, it may be desirable to use one or more entrance electrodes and/or entrance lenses to focus the beam prior to entry into the multipole and to use one or more exit electrodes and/or entrance lenses to focus the beam after the beam exits the multipole. Referring to FIG. 10, a quadrupole is shown comprising electrodes/poles 1010-1040. An entrance lens 1055*a*, 1055*b* is present and adjacent to the pole 1030. The exact voltage applied to the lens 1055*a*, 1055*b* can vary but is shown in FIGS. 10 as −35 Volts applied to 1055*b*. In certain configurations, deflected ions exiting a DC multipole may be focused along a path by providing a "lens" through which deflected ions pass after the exit the multipole. The lens may be comprised of a single lens or a combination of lenses. For example and referring still to FIG. 10, an entrance lens 1065*a*, 1065*b* (shown at −75 Volts in FIG. 10) is positioned between the poles 1020, 1040 and a second lens 1066, which may take the form of a cylindrical Einzel lens, for example. In some instances, the Einzel lens has a ground potential on the cylinder (0 V) and −20 V on the inner lens (inside the cylinder). An additional lens 1067*a*, 1067*b* may be present between the poles and another region, e.g., a different pressure region or some downstream region. In the 90/−45 bend configuration, the voltage applied to the lens 1065*a*, 1065*b* may be about −75 Volts DC. In some instances, it may be desirable to apply a voltage to the housing or box that includes the multipole. For example, in the 90/−45 bend configuration, a DC voltage of about −40 Volts can be applied to the housing. If desired, the lenses can be omitted from the device shown in FIG. 10. In other instances, the lenses 1065*a*, 1065*b* are omitted from the device shown in FIG. 10, and the electrodes lenses 1055*am* 1055*b* and 1066 are retained.

Figure 11:
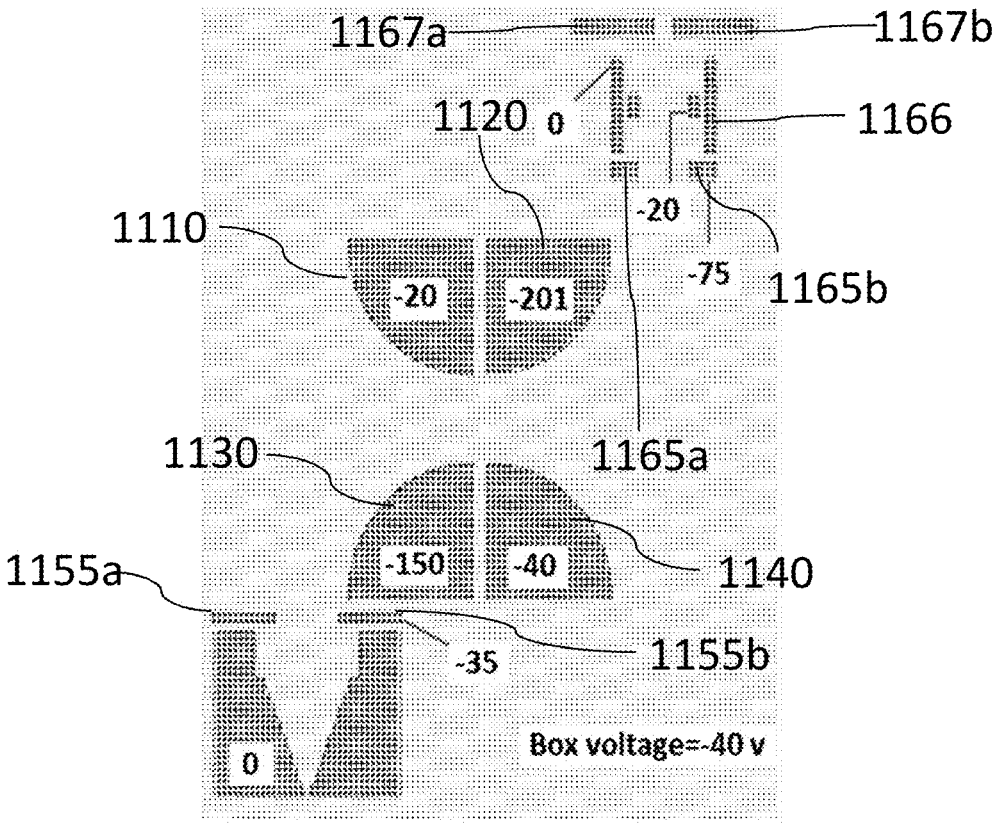
FIG. 11 is another illustration of a multipole with electrodes positioned near entrance and exit apertures of the multipole, in accordance with certain configurations.

In certain embodiments, any lens or lenses that are present can be positioned at different positions depending on the particular double bend configuration of the multipole.

Where electrodes or lenses are present in a system, it may be desirable to adjust the position of the electrodes such that an opening formed between the electrodes receives the beam. Referring to FIG. 11, a multipole is shown comprising poles 1110-1140, an entry lens 1155*a*, 1155*b*, and a lens formed by exit electrodes 1165*a*, 1165*b*. The electrodes 1165*a*, 1165*b* are positioned adjacent to and in a plane tangential to pole 1120 to receive the beam from the poles 1110-1140 through an opening between the lenses 1165*a*, 1165*b*. The exact voltage applied to the lenses can vary. Where the poles 1110-1140 are designed to doubly bend a beam at 90/−90 degrees, the voltage applied to the lens 1155*b* may be about −35 Volts. Flanking the outside surfaces of the DC quadrupoles may increase the adherence of deflected ions to the desired path as they pass through the common space between the electrodes of the quadrupole. In some instances, the potential applied to an electrode flanking the outside surfaces of an electrode around which ions are to be deflected may be higher than that of the electrodes if cations are to be deflected and may be lower than that of the electrodes if anions are to be deflected. In certain configurations, deflected ions exiting after then −90 bend may be focused along a path by providing a "lens" through which deflected ions pass after the exit the multipole. The lens may be comprises of the two plate components 1165*a*, 1165*b* providing an aperture through which exiting ions traverse. In the 90/−90 bend configuration, the voltage applied to the electrode 1165*b* may be about −75 Volts DC. In some instances, it may be desirable to apply a voltage to the housing or box that includes the multipole. For example, in the 90/−90 bend configuration, a DC voltage of about −40 Volts can be applied to the housing. In some instances, the Einzel lens has a ground potential on the cylinder (0 V) and −20 V on the inner lens (inside the cylinder). In certain configurations, an Einzel lens 1166 may be present and positioned between the lens 1165*a*, 1165*b* and an exit lens 1167*a*, 1167*b*. If desired, the electrodes 1155*a*, 155*b* 1165*a* 1165*b* can be omitted from the device shown in FIG. 11. In other instances, the exit electrodes/lenses 1165*a*, 1165*b* are omitted from the device shown in FIG. 11, and the lenses 1155*a*, 1155*b* and 1166 are retained.

Figure 12:
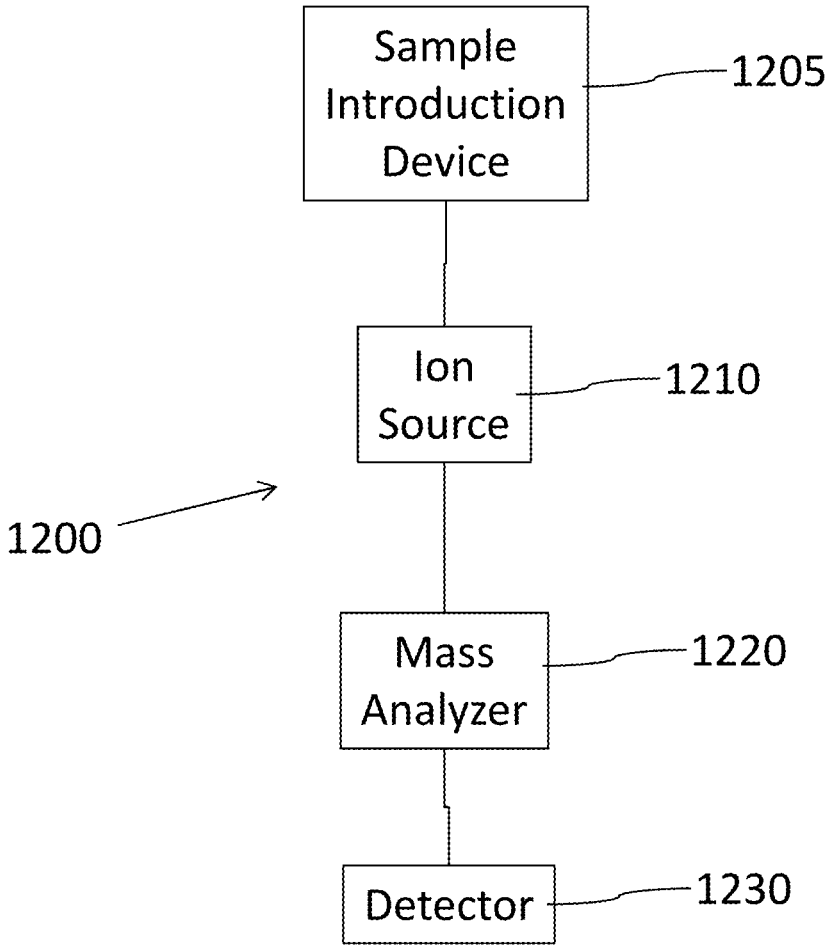
FIG. 12 is a block diagram of a system comprising a double bend multipole, in accordance with certain embodiments.

In certain examples, the double bend multipoles described herein can be used in a system. A block diagram of a system is shown in FIG. 12. The system 1200 comprises an ion source 1210, a mass analyzer 1220 comprising at least one double bend multipole and an optional sample introduction device 1205 fluidically coupled to the ion source and an optional detector 1230 fluidically coupled to the mass analyzer. In some configurations, the sample introduction device 1210 may be configured to aerosolize a liquid sample. Illustrative sample introduction devices include, but are not limited to, nebulizers, spray chambers, spray heads and similar devices. The ion source 1210 may take many forms and typically provides one or more ions. In some instances, the ability to doubly bend the beams within a single multipole may permit the use of "dirty" ion sources such as low power ion sources, electron discharge ion sources and other sources which commonly provide many contaminants or interfering species in addition to the ion or ions of interest. Illustrative ion or ionization sources include, but are not limited to, plasmas (e.g., inductively coupled plasmas, capacitively coupled plasmas, microwave-induced plasmas, etc.), arcs, sparks, drift ion devices, devices that can ionize a sample using gas-phase ionization (e.g., electron ionization, chemical ionization, desorption chemical ionization, negative-ion chemical ionization), field desorption devices, field ionization devices, fast atom bombardment devices, secondary ion mass spectrometry devices, electrospray ionization devices, probe electrospray ionization devices, sonic spray ionization devices, atmospheric pressure chemical ionization devices, atmospheric pressure photoionization devices, atmospheric pressure laser ionization devices, matrix assisted laser desorption ionization devices, aerosol laser desorption ionization devices, surface-enhanced laser desorption ionization devices, glow discharges, resonant ionization, thermal ionization, thermospray ionization, radioactive ionization, ion-attachment ionization, liquid metal ion devices, laser ablation electrospray ionization, or combinations of any two or more of these illustrative ionization devices. The mass analyzer 1220 may take numerous forms depending generally on the sample nature, desired resolution, etc., and exemplary mass analyzers can include one or more double bend multipoles, collision cells, reaction cells or other components as desired. The detector 1230 may be any suitable detection device that may be used with existing mass spectrometers, e.g., electron multipliers, Faraday cups, coated photographic plates, scintillation detectors, etc., and other suitable devices that will be selected by the person of ordinary skill in the art, given the benefit of this disclosure. While not shown, the entire system 1200 is typically controlled using a computer system that includes a microprocessor and/or suitable software for analysis of samples introduced into system 1200.

Certain specific examples are described below to illustrate some of the novel aspects described herein.

Example 1

Figure 13:
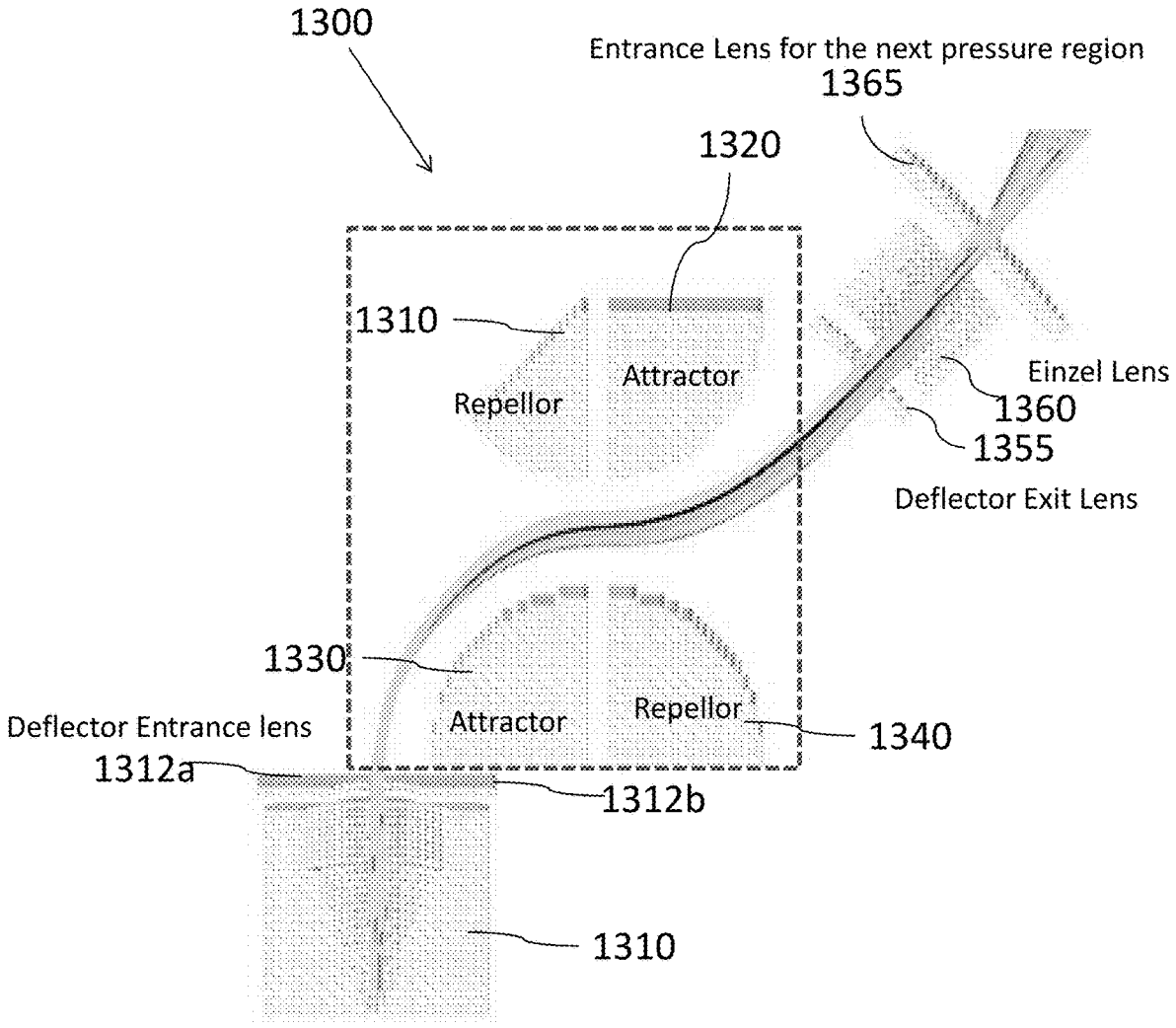
FIGS. 13-16 show various configurations of an ion flow guide, in accordance with certain configurations.

Referring to FIG. 13, a DC quadrupole 1300 is shown that can doubly bend certain ions within an incoming beam. An incoming beam may originate from a source or nozzle 1310 and pass between an aperture formed by a deflector entrance lens 1312*a*, 1312*b*. The beam passes tangential to a pole 1330 and encounters a DC electric field provided by the poles 1310-1340. The DC electric field provided by the poles 1310-1340 bends the beam twice. A first 90 degree bend is followed by a second −45 degree bend. The beam then exits the DC quadrupole 1300 along a plane tangential to the pole 1320. In the configuration shown in FIG. 13, poles 1320-1340 take the form of a quarter cylinder whereas pole 1310 is shaped as ⅛th of a cylinder. When the beam exits the poles 1310-1340, it is provided first to a deflector exit lens 1355 and then to an Einzel lens 1360 that can focus the beam further. An entrance lens 1365 of a downstream region is shown in FIG. 13. To provide the 90/−45 bend shown in FIG. 13, a static DC voltage of −20 Volts is applied to the pole 1310, a static DC voltage of −102 Volts is applied to the pole 1320, a static DC voltage of −130 Volts is applied to the pole 1330 and a static DC voltage of −30 Volts is applied to the pole 1340. A DC voltage of −35 Volts is applied to the lens 1312*a*, 1312*b*. A static DC voltage of −40 Volts is applied to the box housing the poles 1310-1340. A static DC voltage of −75 Volts is applied to the lens 1355. A static DC voltage of −20 Volts is applied to the Einzel lens 1360 (a ground potential on the cylinder (0 V) and −20 V on the inner lens inside the cylinder). In this example, the applied DC voltages are effective to direct an ion beam comprising ions with masses ranging from 7-254 amu's (atomic mass units) and with ion energies between 2 and 10 eV. If desired, the lenses 1355, 1360 may be present in a common component to facilitate easier assembly. If the ion energies were to change or the pressures of the system were to change, then the particular voltage parameters may also be changed to provide for a desired double deflection by the poles 1310-1340.

Example 2

Figure 14:
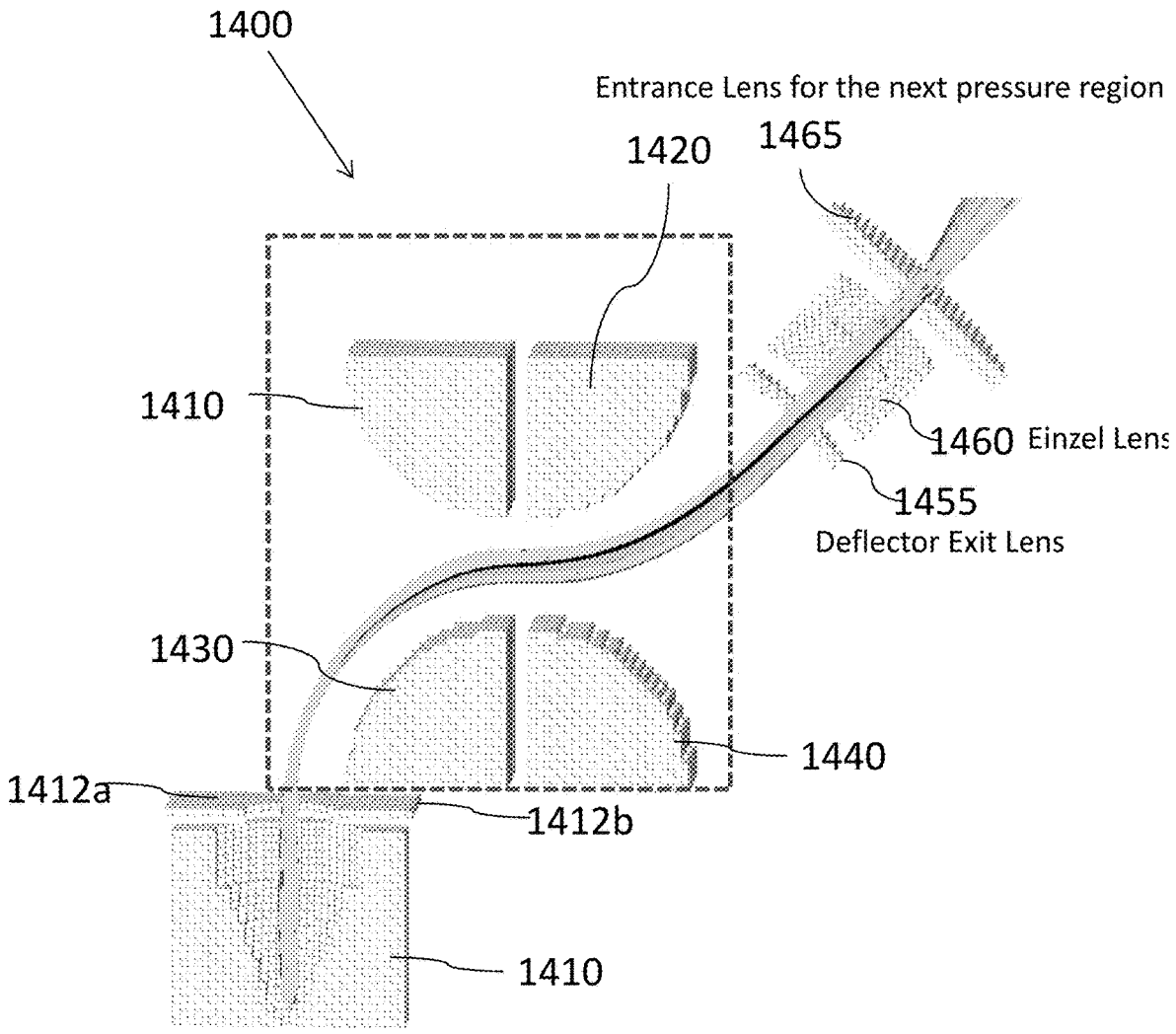

Referring to FIG. 14, a DC quadrupole 1400 is shown that can doubly bend certain ions within an incoming beam. An incoming beam may originate from a source or nozzle 1410 and pass between an aperture formed by the lenses 1412*a*, 1412*b*. The beam passes tangential to a pole 1430 and encounters a DC electric field provided by the poles 1410-1440. The DC electric field provided by the poles 1410-1440 bends the beam twice. A first 90 degree bend is followed by a second −45 degree bend. The beam then exits the DC quadrupole 1400 along a plane tangential to the pole 1420. In the configuration shown in FIG. 14, poles 1410-1440 each take the form of a quarter cylinder. When the beam exits the poles 1410-1440, it is provided to a lens 1460 that can focus the beam further. To provide the 90/−45 bend shown in FIG. 14, a static DC voltage of −20 Volts is applied to the pole 1410, a static DC voltage of −103 Volts is applied to the pole 1420, a static DC voltage of −130 Volts is applied to the pole 1430 and a static DC voltage of −30 Volts is applied to the pole 1440. A DC voltage of −35 Volts is applied to the lens 1412*a*, 1412*b*. A static DC voltage of −40 Volts is applied to the box housing the poles 1410-1440. A static DC voltage of −75 Volts is applied to the lens 1455. A static DC voltage of −20 Volts is applied to the Einzel lens 1460 (a ground potential on the cylinder (0 V) and −20 V on the inner lens inside the cylinder). An entrance lens 1465 for another region of the instrument or device is shown. In this example, the applied DC voltages are effective to direct an ion beam comprising ions with masses ranging from 7-254 amu's and with ion energies between 2 and 10 eV. If the ion energies were to change or the pressures of the system were to change, then the particular voltage parameters may also be changed to provide for a desired double deflection by the poles 1410-1440.

Example 3

Figure 15:
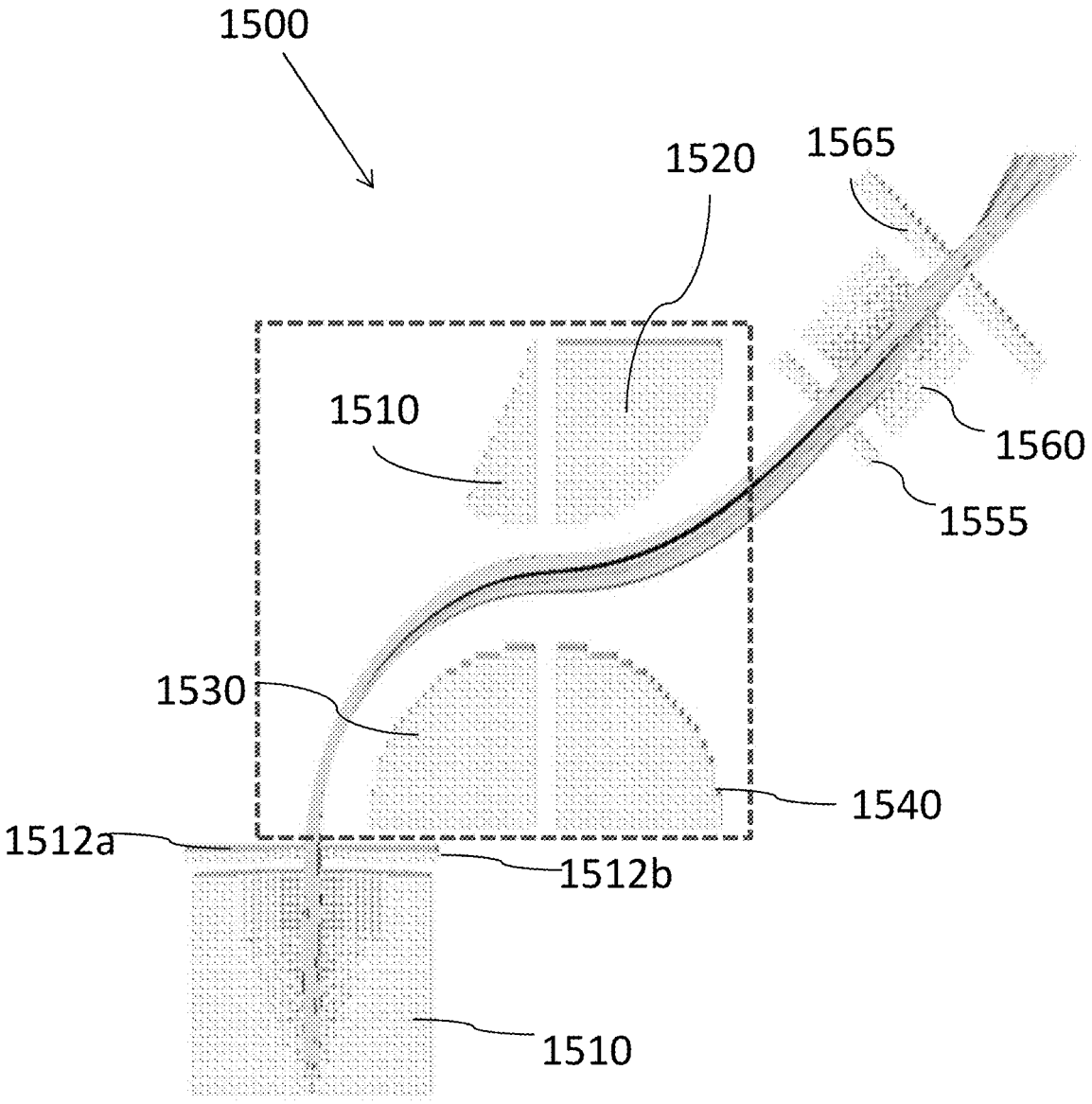

Referring to FIG. 15, a DC quadrupole 1500 is shown that can doubly bend certain ions within an incoming beam. An incoming beam may originate from a source or nozzle 1510 and pass between an aperture formed by a lens 1512*a*, 1512*b*. The beam passes tangential to a pole 1530 and encounters a DC electric field provided by the poles 1510-1540. The DC electric field provided by the poles 1510-1540 bends the beam twice. A first 90 degree bend is followed by a second −25 degree bend. The beam then exits the DC quadrupole 1500 along a plane tangential to the pole 1520. In the configuration shown in FIG. 15, poles 1520-1540 each take the form of a quarter cylinder, and pole 1510 takes the form of 1/16th of a cylinder. When the beam exits the poles 1510-1540, it is provided to lenses 1555 and 1560 that can focus the beam further. To provide the 90/−25 bend shown in FIG. 15, a static DC voltage of −20 Volts is applied to the pole 1510, a static DC voltage of −99 Volts is applied to the pole 1520, a static DC voltage of −130 Volts is applied to the pole 1530 and a static DC voltage of −30 Volts is applied to the pole 1540. A DC voltage of −35 Volts is applied to the lens 1512*a*, 1512*b*. A static DC voltage of −40 Volts is applied to the box housing the poles 1510-1540. A static DC voltage of −75 Volts is applied to the lens 1555. A static DC voltage of −20 Volts is applied to the Einzel lens 1560 (a ground potential on the cylinder (0 V) and −20 V on the inner lens inside the cylinder). In this example, the applied DC voltages are effective to direct an ion beam comprising ions with masses ranging from 7-254 amu's and with ion energies between 2 and 10 eV. If the ion energies were to change or the pressures of the system were to change, then the particular voltage parameters may also be changed to provide for a desired double deflection by the poles 1510-1540.

Example 4

Figure 16:
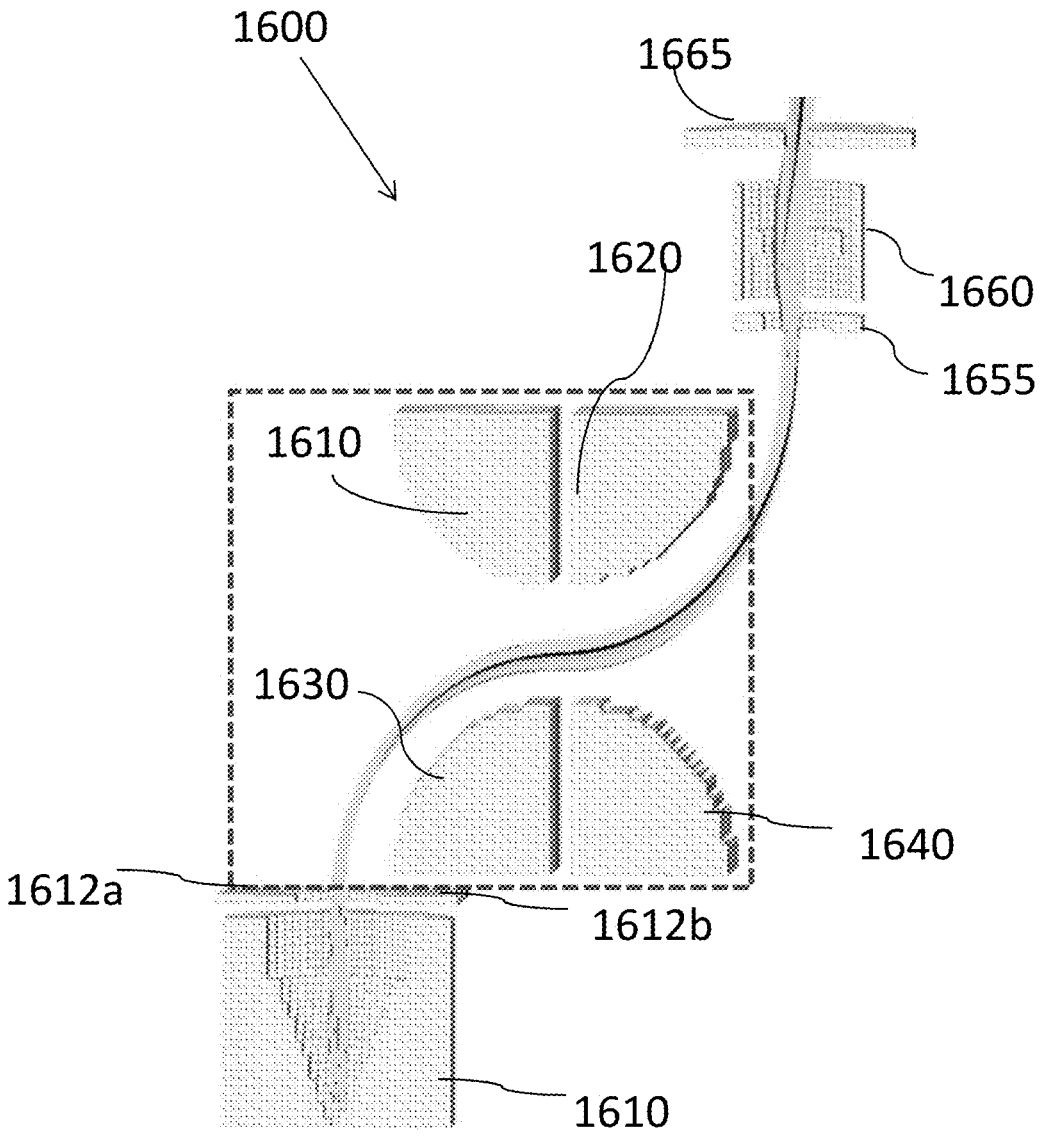

Referring to FIG. 16, a DC quadrupole 1600 is shown that can doubly bend certain ions within an incoming beam. An incoming beam may originate from a source or nozzle 1610 and pass between an aperture formed by a lens 1612*a*, 1612*b*. The beam passes tangential to a pole 1630 and encounters a DC electric field provided by the poles 1510-1540. The DC electric field provided by the poles 1610-1640 bends the beam twice. A first 90 degree bend is followed by a second −90 degree bend. The beam then exits the DC quadrupole 1600 along a plane tangential to the pole 1620. In the configuration shown in FIG. 16, poles 1610-1640 each take the form of a quarter cylinder. When the beam exits the poles 1610-1640, it is provided to a lens 1655 and to an Einzel lens 1660 that can focus the beam further. To provide the 90/−90 bend shown in FIG. 16, a static DC voltage of −20 Volts is applied to the pole 1610, a static DC voltage of −201 Volts is applied to the pole 1620, a static DC voltage of −150 Volts is applied to the pole 1630 and a static DC voltage of −40 Volts is applied to the pole 1640. A DC voltage of −35 Volts is applied to the lens 1612*a*, 1612*b*. A static DC voltage of −40 Volts is applied to the box housing the poles 1610-1640. A static DC voltage of −75 Volts is applied to the lens 1655. A static DC voltage of −20 Volts is applied to the Einzel lens 1660 (a ground potential on the cylinder (0 V) and −20 V on the inner lens inside the cylinder). In this example, the applied DC voltages are effective to direct an ion beam comprising ions with masses ranging from 7-254 amu's and with ion energies between 2 and 10 eV. If the ion energies were to change or the pressures of the system were to change, then the particular voltage parameters may also be changed to provide for a desired double deflection by the poles 1510-1540.

In the foregoing description, for purposes of explanation and not limitation, specific details are set forth, such as particular valves, configurations, devices, components, techniques, samples, and processes, etc. in order to provide a thorough understanding of the present invention. However, it will be apparent to one skilled in the art that the technology described herein may be practiced in other embodiments that depart from these specific details. Detailed descriptions of other components that may be present in a device or system or used in a method, e.g., valves, sensors, heating devices, gases, materials, analytes, configurations, devices, ranges, temperatures, components, techniques, vessels, samples, and processes, etc., have been omitted so as not to obscure the description of the illustrative embodiments presented herein. As used in the foregoing description, the terms "inward," "outside," "top," "bottom," "above," "below," "over," "under," "above," "beneath," "on top," "underneath," "up," "down," "upper," "lower," "front," "rear," "back," "forward" and "backward" refer to the objects referenced when in the orientation illustrated in the drawings, which orientation is not necessary for achieving the objects of the invention.

When introducing elements of the aspects, embodiments and examples disclosed herein, the articles "a," "an," "the"

and "said" are intended to mean that there are one or more of the elements. The terms "comprising," "including" and "having" are intended to be open-ended and mean that there may be additional elements other than the listed elements. It will be recognized by the person of ordinary skill in the art, given the benefit of this disclosure, that various components of the examples can be interchanged or substituted with various components in other examples. Although certain aspects, examples and embodiments have been described above, it will be recognized by the person of ordinary skill in the art, given the benefit of this disclosure, that additions, substitutions, modifications, and alterations of the disclosed illustrative aspects, examples and embodiments are possible.

What is claimed is:

1. A method comprising:

deflecting ions of a particle beam that enter an ion flow guide, wherein the ion flow guide comprises a housing comprising an entrance, a first multipole fluidically coupled to the entrance, and an exit fluidically coupled to the first multipole, wherein the ions of the particle beam enter into the housing along an entry trajectory and are deflected by a first static DC electric field from the first multipole to a first internal trajectory at a first angle to the entry trajectory of the entering particle beam, in which the first angle is different than an angle of the entry trajectory of the entering particle beam; and deflecting the deflected ions along the first internal trajectory to a second internal trajectory at a second angle using a second static DC electric field from the first multipole, in which the second angle is different than the first angle, and wherein the deflected ions along the second internal trajectory exit the housing of the ion flow guide through the exit.

2. The method of claim 1, further comprising configuring the first static DC electric field provided by a first set of electrodes of the first multipole to deflect the ions of the entering particle beam at the first angle of about ninety degrees to remove photons in the entering particle beam.

3. The method of claim 2, further comprising configuring the second static DC electric field provided by a second set of electrodes of the first multipole to deflect the ions along the first internal trajectory at the second angle of about ninety degrees to remove remaining photons.

4. The method of claim 2, further comprising configuring the second static DC electric field provided by a second set of electrodes of the first multipole to deflect the ions along the second trajectory at the second angle of about forty-five degrees to remove remaining photons.

5. The method of claim 1, further comprising focusing the deflected ions exiting the first multipole along the second internal trajectory using at least one lens.

6. The method of claim 1, further comprising focusing ions entering the entrance of the housing using a set of electrodes.

7. The method of claim 1, further comprising applying a direct current voltage to at least one pole of the first multipole.

8. The method of claim 1, further comprising configuring at least one pole of the first multipole to comprise a different cross-sectional shape than other poles of the first multipole.

9. The method of claim 1, further comprising altering a voltage applied to at least one pole of the first multipole to change the first angle or the second angle or both.

10. The method of claim 1, further comprising deflecting the ions exiting the housing along the second internal trajectory using at least one flanking electrode.

11. A system comprising:

a sample introduction device;

an ionization source fluidically coupled to the sample introduction device;

an ion flow guide fluidically coupled to the ionization source, in which the ion flow guide comprises a housing comprising an entrance configured to receive ions in an entering particle beam from the ionization source, wherein the housing further comprises a first multipole fluidically coupled to the entrance, and wherein the housing comprises an exit fluidically coupled to the first multipole, wherein the first multipole comprises a plurality of electrodes configured to provide a first static DC electric field effective to direct incoming ions of the entering particle beam to a first internal trajectory at a first angle to an entry trajectory of the entering particle beam, wherein the first angle is different than an angle of the entry trajectory of the entering particle beam, in which the plurality of electrodes of the first multipole are further configured to provide a second static DC electric field to direct the directed ions along the first trajectory to a second internal trajectory at a second angle; and a mass analyzer fluidically coupled to the ion flow guide and configured to receive ions exiting the exit of the ion flow guide.

12. The system of claim 11, in which a first set of poles of the first multipole are configured to provide the first static DC electric field to direct the ions of the entering particle beam to the first internal trajectory, and a second set of poles of the first multipole is configured to provide the second static DC electric field to direct the directed ions to the second internal trajectory.

13. The system of claim 12, in which each of the first set and the second set comprises a pair of poles.

14. The system of claim 12, in which the first set of poles is configured to provide the first static DC electric field using a direct current voltage applied to each electrode of the first set of poles, and wherein the second set poles is configured to provide the second DC electric field using a direct current voltage applied to each electrode of the second set of poles.

15. The system of claim 14, in which the direct current voltage applied to each electrode is a different direct current voltage.

16. The system of claim 11, in which the plurality of electrodes are configured to direct the directed ions along the second internal trajectory in a direction that is substantially parallel to a direction of the entry trajectory.

17. The system of claim 11, in which the plurality of electrodes are configured to direct the directed ions along the second internal trajectory in a direction that is substantially antiparallel to a direction of the entry trajectory.

18. The system of claim 11, further comprising at least one electrode positioned at the exit of the housing.

19. The system of claim 11, further comprising at least one lens positioned at the exit of the housing.

20. The system of claim 11, in which the first multipole is configured as a DC quadrupole, and wherein the system comprises a processor to control direct current voltages provided to the plurality of electrodes of the DC quadrupole.

* * * * *